US006951704B2

(12) United States Patent
Tsuji et al.

(10) Patent No.: US 6,951,704 B2
(45) Date of Patent: Oct. 4, 2005

(54) PROCESS FOR PRODUCING TONER PARTICLES

(75) Inventors: Yoshinori Tsuji, Shizuoka (JP); Hidekazu Fumita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/702,609

(22) Filed: Nov. 7, 2003

(65) Prior Publication Data

US 2004/0096767 A1 May 20, 2004

(30) Foreign Application Priority Data

Nov. 8, 2002 (JP) ..... 2002-324674
Apr. 4, 2003 (JP) ..... 2003-101656

(51) Int. Cl.[7] ..... G03G 9/08

(52) U.S. Cl. ..... 430/137.14; 430/137.1; 430/137.17

(58) Field of Search ..... 430/137.1, 137.14, 430/137.15, 137.17

(56) References Cited

U.S. PATENT DOCUMENTS 3,988,235 A 10/1976 Shibata et al. ..... 204/266
5,346,798 A 9/1994 Kamiyama et al.
6,080,519 A 6/2000 Ishiyama et al.
6,309,788 B1 * 10/2001 Tsuji et al. ..... 430/137.17

FOREIGN PATENT DOCUMENTS

JP 36-10231 7/1961
JP 51-14895 2/1976
JP 59-53856 3/1984
JP 59-61842 4/1984
JP 6-273977 9/1994
JP 8-134359 5/1996
JP 10-232510 9/1998
JP 10-301333 11/1998
JP 2000-81721 3/2000
JP 2001-255697 9/2001
JP 3248747 1/2002
JP 3298443 7/2002

* cited by examiner

*Primary Examiner*—Janis L. Dote
(74) *Attorney, Agent, or Firm*—Fitzpatrick, Cella, Harper & Scinto

(57) ABSTRACT

In a process for producing toner particles by pre-dispersing at least a colorant and/or a release agent in a first dispersion medium to prepare a first fluid mixture, preparing a second fluid mixture from the first fluid mixture by means of a fine-dispersion machine, and forming toner particles from the second fluid mixture;

(i) the fine-dispersion machine has at least a first treatment ring and a second treatment ring approachable to and separable from the former and a rotary drive mechanism which makes the former rotate relatively to the latter, and (ii) the first fluid mixture is introduced to the part between the first treatment ring and the second treatment ring to make the latter separate from the former, and the colorant and/or the release agent are dispersed in the form of fine particles by the rotation of the first treatment ring to obtain the second fluid mixture.

11 Claims, 8 Drawing Sheets

PROCESS FOR PRODUCING TONER PARTICLES

BACKGROUND OF THE INVENTION

1. Field of the Invention

This invention relates to a process for producing toner particles having superior electrophotographic performance in each particle of which a colorant and a release agent or a mixture of these stand(s) dispersed finely and uniformly. This invention also relates to a process by which the toner particles having superior electrophotographic performance in each particle of which a colorant and a release agent or a mixture of these stand(s) dispersed finely and uniformly are produced controlling any excess power consumption.

This invention still also relates to a process by which toner particles containing no coarse particles and having sharp particle size distribution are obtained in a high efficiency.

2. Related Background Art

Conventionally, electrophotography is a process in which fixed images are obtained by forming an electrostatic latent image on a photosensitive member by various means, subsequently developing the latent image by the use of a toner to form a toner image, and transferring the toner image to a transfer medium such as paper as occasion calls, followed by fixing by the action of heat, pressure, heat and pressure or solvent vapor to form a fixed image.

Toners used therefor are commonly produced by melt-kneading a colorant into a thermoplastic resin to effect dispersion uniformly, thereafter cooling the resultant melt-kneaded product to solidify, finely pulverizing the kneaded product by means of a fine grinding mill, and classifying the finely pulverized product by means of a classifier to obtain toner particles having the desired particle diameters, followed by external addition of stated additives to produce a toner.

Reasonably good toners can be produced by such a production method, but there is a limit to the range in which toner materials are selected. For example, in the case when the toner particles are produced by pulverization, kneaded products must be brittle enough to be pulverizable by means of economically available production apparatus. Kneaded products made brittle in order to meet these requirement tend to result in a broad particle size range of the particles formed when actually pulverized at a high speed, especially causing a problem that fine particles tend to be included in the particles in a relatively large proportion. Moreover, toners making use of such highly brittle materials tend to be further pulverized or powdered when used in, e.g., copying machines.

In this pulverization method, it is also not easy to uniformly disperse solid fine particles of colorants or the like in the resin, and, depending on the degree of their dispersion, toners may cause an increase in fog, a decrease in image density and a lowering of color mixing properties or transparency when images are formed. Accordingly, care must well be taken when colorants are dispersed. Also, colorants may come bare to surfaces of toner particles to cause fluctuations in developing performance of toners.

Meanwhile, in order to overcome the problems of the toners produced by such pulverization, toners produced by suspension polymerization and other various polymerization toners, as well as methods of producing such toners are proposed as disclosed in Japanese Patent Application Laid-open No. 51-14895 and so forth. For example, in the suspension polymerization, a colorant is dispersed in a polymerizable monomer to obtain a polymerizable monomer mixture, and thereafter a polymerization initiator and also optionally a cross-linking agent, a charge control agent and other additives are uniformly dissolved or dispersed to form a polymerizable monomer composition. Thereafter, this polymerizable monomer composition is dispersed in an aqueous medium containing a dispersion stabilizer, by means of a suitable agitator, and is simultaneously subjected to polymerization to polymerize the polymerizable monomer to obtain toner particles having the desired particle diameters.

Since this method has no step of pulverization, the toner particles are not required to be brittle, and hence soft resins can be used as the resin constituting the toner particles. Also, colorants can not easily come bare to the surfaces of toner particles and hence the toner particles can have a uniform triboelectric charging performance. This method has such advantages. Also, since the toner particles obtained have a relatively sharp particle size distribution, the step of classification can be omitted, or even when classification is carried out, the toner particles can be obtained in a high yield.

This method also has another advantage that a low-softening materials as a release agent can be encapsulated in toner particles in a large quantity and in plural kinds and hence the toner particles obtained can have excellent anti-offset properties.

In the production of toner particles by polymerization, it is important to make the particulate, colorant or release agent or the both sufficiently dispersed or dissolved in the liquid, polymerizable monomer. Accordingly, it is common to make the polymerizable monomer serve as a liquid medium and employ a dispersion step of dispersing therein the colorant or release agent or the both. Various apparatus are also known as dispersion machines used in such a dispersion step.

In the past, as disclosed in Japanese Patent Application Laid-open No. H10-232510, a method has been proposed in which an agitation media type dispersion machine is used in order to disperse the colorant in the polymerizable monomer in the form of fine particles to obtain a fluid mixture. As also disclosed in Japanese Patent No. 3298443 and Japanese Patent Applications Laid-open No. H6-273977 and No. H8-134359, a method is proposed in which the agitation media type dispersion machine is used in order to disperse in the polymerizable monomer a release agent which is substantially insoluble therein at normal temperature or within the range of temperature having been controlled during production, to obtain a fluid mixture.

However, in such an agitation media type dispersion machine, the particles of colorant or the particles of release agent are dispersed or crushed by the aid of their collision against media and shear stress between them, and hence kinetic energy must be applied to the media by agitation. This energy is so large as to cause a rise in production cost for toner particles. Also, the energy applied is not only used in dispersion or crushing but also used as the generation of heat that is caused by collision between media and by collision of media against a machine casing. This generation of heat may adversely affect the polymerizable monomer, e.g., make it undergo thermal polymerization. Accordingly, the machine casing is set up in a jacket structure to keep the heat from being generated, or a heat exchanger is provided outside the machine to eliminate the heat generated. Excess heat generation caused by agitation results in wasteful use of energy.

Especially in recent years, media with small diameter (stated specifically, media of 0.05 mm to 2 mm in diameter) are often used in order to improve the degree of dispersion in the agitation media type dispersion machine. The use of such media with small diameter enables the media to be densely packed, and hence the degree of dispersion can dramatically been improved. This, however, has caused a problem that the agitation power increases correspondingly. In addition, friction tends to be produced between the media and the machine casing surface with which the former comes into contact, bringing about a possibility that wear dust contaminates toner particles more frequently.

Without using such an agitation media type dispersion machine consuming a large power (electric power), a medialess dispersion machine (a dispersion machine commonly called a colloid mill) may also be used to restrain excess power consumption, but it has not been easy to achieve the desired dispersion.

Further, in the production of toner particles by polymerization, it is important, in view of characteristic features of the production process, that fine particles of a polymerizable monomer composition which have the desired particle diameter and a sharp particle size distribution are obtained in the step of granulation. In the past, in this step of granulation, continuous granulation has been proposed, aiming at simplification of the production steps. This continuous granulation is a method in which the polymerizable monomer composition is continuously fed to a granulating machine to obtain a cluster of droplets of the polymerizable monomer composition in the desired size, and thereafter an aqueous medium containing the cluster of droplets obtained is taken out, which is then led to a polymerization bath, where the polymerization is completed to obtain polymer particles. Such a method is disclosed in Japanese Patent No. 3248747 and Japanese Patent Application Laid-open No. 2001-255697.

The granulating machine used in this method is an apparatus called a colloid mill, constituted of agitating blades rotated by means of a rotating shaft, and a discharge-controlling gap provided around them. In this discharge-controlling gap, a polymerizable monomer composition ejected by an ejection force produced by the rotation of the blades is agitated by a shear force to come to be the desired fine particles. The granulating machine having such a discharge-controlling gap has commonly been used in the continuous granulation. As this gap, a gap of about 1 to 10 mm is provided in order to avoid contact with the agitating blades rotated at a high speed. Taking account of shaft run-out of the rotating shaft and its mechanical precision, it is difficult to narrow the gap more than this. However, toners for electrophotography have particle diameters of 3 to 15 $\mu$m, and the shear force produced at the gap that is hundreds of times to thousands of times the particle diameters is not enough to effect sufficient continuous granulation, to cause short pass or shortage of shear force, making it difficult to achieve the desired toner particle diameter and particle size distribution.

SUMMARY OF THE INVENTION

An object of the present invention is to provide a process for producing toner particles that has solved the problems discussed above.

Another object of the present invention is to provide, in a process for producing toner particles which has the step of dispersing a release agent or a colorant or the both in a liquid medium, a process for producing toner particles by which, restraining excess power consumption and keeping dispersibility from lowering, toner particles in which the colorant stands dispersed more homogeneously and the release agent which is substantially insoluble at normal temperature or within the range of temperature having been controlled during production stands dispersed more homogeneously and which promise good image density and anti-offset properties can be produced in a high efficiency and stably.

Still another object of the present invention is to provide a process for producing toner particles in which a polymerizable monomer composition is continuously fed to a granulating machine to obtain a cluster of droplets of the polymerizable monomer composition in the desired size, and an aqueous medium containing the cluster of droplets obtained is taken out, which is then led to a polymerization bath, where the polymerization of the polymerizable monomer in the polymerizable monomer composition is completed to obtain toner particles, and which is a process for producing toner particles containing no coarse particles and having a sharp particle size distribution.

To achieve the above objects, the present invention provides a process for producing toner particles, which comprises:

pre-dispersing at least a colorant or a release agent or a mixture of these in a first dispersion medium to prepare a first fluid mixture;

preparing a second fluid mixture through a dispersion step of dispersing the colorant or the release agent or the mixture of these contained in the first fluid mixture, in the form of fine particles by means of a fine-dispersion machine; and optionally adding a second dispersion medium to the second fluid mixture to form toner particles from the second fluid mixture;

wherein;

(i) the fine-dispersion machine has:

at least a first treatment ring and a second treatment ring which is approachable to and separable from the first treatment ring; and a rotary drive mechanism which makes the first treatment ring rotate relatively to the second treatment ring;

the second treatment ring being pressed against the first treatment ring when the first treatment ring stands stationary; and (ii) the first fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second fluid mixture.

The present invention also provides a process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture, in the form of fine particles by means of a fine-dispersion machine;

dispersing the resultant second polymerizable-monomer fluid mixture in an aqueous dispersion medium containing a dispersion stabilizer, to carry out granulation to obtain particles of the polymerizable-monomer fluid mixture; and polymerizing the polymerizable monomer present in the particles of the polymerizable-monomer fluid mixture to obtain toner particles;

wherein;

(i) the fine-dispersion machine has:

at least a first treatment ring and a second treatment ring which is approachable to and separable from the first treatment ring; and a rotary drive mechanism which makes the first treatment ring rotate relatively to the second treatment ring;

the second treatment ring being pressed against the first treatment ring when the first treatment ring stands stationary; and (ii) the first polymerizable-monomer fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second polymerizable-monomer fluid mixture.

The present invention still also provides a process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture, in the form of fine particles by means of a fine-dispersion machine;

adding an additive to the resultant second polymerizable-monomer fluid mixture to obtain a third polymerizable-monomer fluid mixture;

dispersing the resultant third polymerizable-monomer fluid mixture in an aqueous dispersion medium containing a dispersion stabilizer, to carry out granulation to obtain particles of the polymerizable-monomer fluid mixture; and polymerizing the polymerizable monomer present in the particles of the polymerizable-monomer fluid mixture to obtain toner particles;

wherein;

(i) the fine-dispersion machine has:

at least a first treatment ring and a second treatment ring which is approachable to and separable from the first treatment ring; and a rotary drive mechanism which makes the first treatment ring rotate relatively to the second treatment ring;

the second treatment ring being pressed against the first treatment ring when the first treatment ring stands stationary; and (ii) the first polymerizable-monomer fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second polymerizable-monomer fluid mixture.

The present invention further provides a process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture, in the form of fine particles by means of a fine-dispersion machine;

adding an additive to the resultant second polymerizable-monomer fluid mixture to obtain a third polymerizable-monomer fluid mixture;

dispersing the resultant third polymerizable-monomer fluid mixture in an aqueous dispersion medium containing a dispersion stabilizer, to carry out granulation by means of a granulating machine to obtain particles of the third polymerizable-monomer fluid mixture; and polymerizing the polymerizable monomer present in the particles of the polymerizable-monomer fluid mixture to obtain toner particles;

wherein;

(i) the granulating machine has:

at least a first treatment ring and a second treatment ring which is approachable to and separable from the first treatment ring; and a rotary drive mechanism which makes the first treatment ring rotate relatively to the second treatment ring;

the second treatment ring being pressed against the first treatment ring when the first treatment ring stands stationary; and (ii) the third polymerizable-monomer fluid mixture and said aqueous dispersion medium are introduced to the part between the first treatment ring and the second treatment ring to make the second treatment ring separate from the first treatment ring, and the third polymerizable-monomer fluid mixture is dispersed in said aqueous dispersion medium by the aid of the rotation of the first treatment ring to carry out granulation to obtain particles of the third polymerizable-monomer fluid mixture.

DESCRIPTION OF THE PREFERRED EMBODIMENTS

Figure 1:
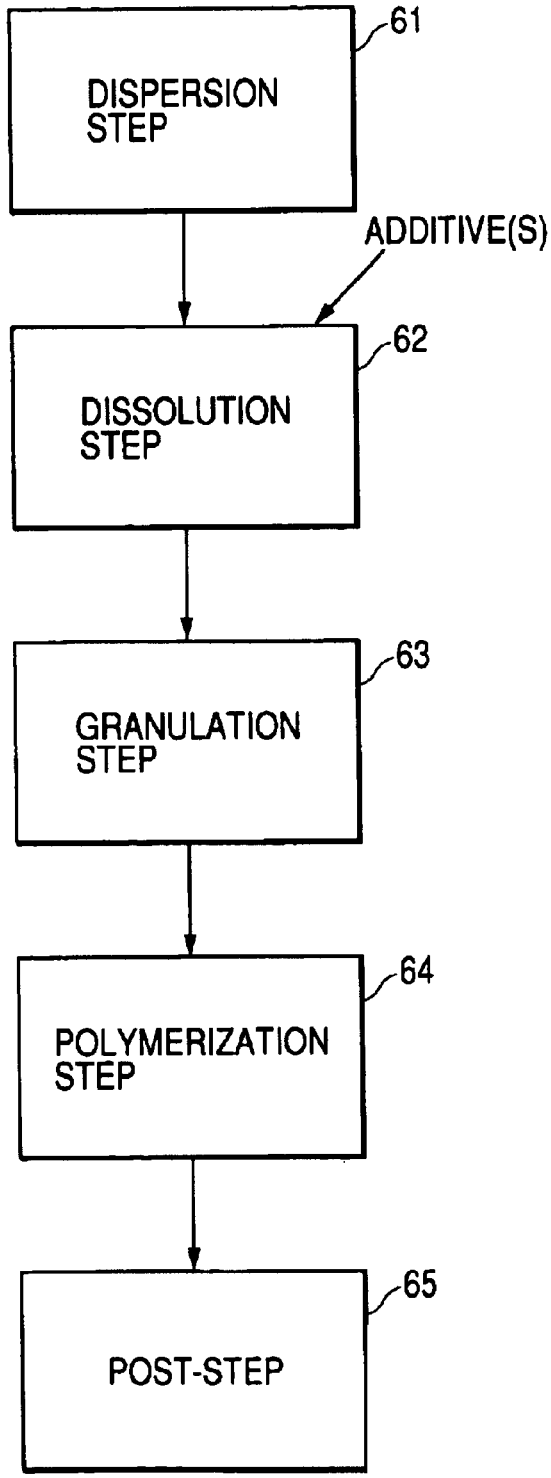
FIG. 1 is a diagram showing an example of a system in which a fine-dispersion machine used in the present invention has been set.

As a result of extensive studies made in order to solve the problem the prior art has had, the present inventors have invented a process for producing toner particles which makes use of energy efficiently.

The present invention is a process for producing toner particles which is based on the idea that is quite different from conventional systems where the interspace between the first treatment ring and the second treatment ring is mechanically kept constant, and makes use of a fine-dispersion machine or a granulating machine in the step of dispersion or the step of granulation, respectively, in which machine the interspace between the first treatment ring and the second treatment ring is so set as to be a stated microscopic interspace.

First, the step of dispersion is described below.

Utilizing the principle used in a mechanical seal, the pressure plane between the first treatment ring and the second treatment ring is so set that the second treatment ring presses the first treatment ring, and thereafter a stated pressure applied to a fluid mixture by means of a machine such as a pump is utilized to make the first treatment ring and the second treatment ring separate. As the result, a fluid film with a microscopic layer thickness can be formed between the first treatment ring and the second treatment ring. Then, a rotary drive mechanism provided in the fine-dispersion machine is driven to rotate the first treatment ring relatively to the second treatment ring, whereby a large shear force can be imparted to the fluid mixture within the microscopic interspace between both the treatment rings. As the result, any highly precise homogeneous dispersion that has not been achievable in the past or any dispersion regulated on the order of microscopic particle diameter that has not been achievable in the past can be materialized. In virtue of the large shear force, any secondarily agglomerated or multi-order agglomerated particles can be disintegrated into fine particles, or any secondarily agglomerated or multi-order agglomerated particles can be disintegrated into primary particles, or large particles can be made fine or crushed. Hence, this has made it possible to obtain a fluid mixture containing a colorant and/or a release agent having been dispersed in the form of fine particles which is in the state of dispersion that has been difficult for conventional roll mills or colloid mills to achieve.

Moreover, there is no longer any possibility of the contamination of polymerizable-monomer fluid mixtures that is due to the wear of media or the wear of casing members of dispersion machines as in the cases of conventional media mills.

The fine-dispersion machine may preferably be provided with a cushioning mechanism which cushions any fine vibration or alignment of at least one of the first treatment ring and the second treatment ring. The use of a floating structure provided with the cushioning mechanism in this way enables absorption of alignment such as shaft run-out and enables elimination of a possibility of causing any troubles caused by, e.g., wear due to contact.

The fine-dispersion machine may also preferably be provided with a separation stayer which, in driving the fine-dispersion machine, defines the maximum interspace between the first treatment ring and the second treatment ring and stops both the treatment rings from coming more separate than the maximum interspace. This makes it possible to prevent the interspace between the first treatment ring and the second treatment ring from coming larger than is necessary and to carry out uniform dispersion treatment surely and smoothly.

The fine-dispersion machine may also preferably be provided with an approach stayer which, in driving the fine-dispersion machine, defines the minimum interspace between the first treatment ring and the second treatment ring and stops both the treatment rings from approaching more closely than the minimum interspace. This makes it possible to prevent the interspace between the first treatment ring and the second treatment ring from coming smaller than is necessary and to carry out uniform dispersion treatment surely and smoothly.

The fine-dispersion machine may also preferably be provided with a jacket for temperature control which controls the temperature of one or both of the first treatment ring and the second treatment ring. Such a jacket for temperature control makes it possible to heat or cool one or both of the first treatment ring and the second treatment ring to temperature suited for carrying out dispersion treatment and to carry out dispersion treatment in a higher efficiency and a higher precision.

It is also preferable that at least part of one or both of surfaces where the first treatment ring and the second treatment ring face each other has been mirror-finished. Stated specifically, the mirror-finished surface may preferably have a surface roughness Ra of:

$$0.01\ \mu m < Ra < 0.50\ \mu m;\ \text{and more preferably}$$

$$0.02\ \mu m < Ra < 0.30\ \mu m.$$

Having an Ra of smaller than 0.01 $\mu$m is undesirable because a high working cost may result. Having an Ra of larger than 0.50 $\mu$m is also undesirable because the surface may have a low contact performance to lower mechanical sealability, and makes it difficult to obtain the stated pressure even if a pressure is applied to the fluid mixture by means of a machine such as a pump, so that the rings can not easily be separated in a proper condition. Inasmuch as the fine-dispersion machine has the mirror-finished surface, the dispersion treatment at the interspace between the first treatment ring and the second treatment ring can be carried out at a higher precision, also making it possible to carry out finer dispersion treatment and still also to keep wear from being caused between both the treatment rings.

The first treatment ring may preferably be rotated at a peripheral speed (per second) of from 10 m/s to 100 m/s at its outermost edge. If its peripheral speed is less than 10 m/s, any necessary shear force may be obtained with difficulty. If on the other hand it is more than 100 m/s, excess centrifugal force may be produced to cause a problem on the stability of the machine at the time of drive.

The first treatment ring may preferably be provided with recesses in a radial form, and it is preferable to make the second treatment ring separate from the first treatment ring with the rotation of the first treatment ring. If necessary, the recesses may be provided in the second treatment ring.

Forming the recesses in the first treatment ring or the second treatment ring or the both of these makes it possible for the fluid mixture to flow through the recesses at the time of rotation to produce dynamic pressure in virtue of the flow of the fluid mixture, where a separating force acts on both treating surfaces to surely form a more favorable fluid film with the rotation of the first treatment ring in non-contact with the second treatment ring. This also enhances agitation power to enable more efficient dispersion treatment.

In order to make adjustment of the interspace between the first treatment ring and the second treatment ring in the step of dispersion, it is preferable for the second treatment ring to be loaded with a back pressure P of:

$$1\ kPa < P < 800\ kPa.$$

If the back pressure P is less than 1 kPa, the fluid mixture may be discharged in excess from the machine in the step of dispersion because of a centrifugal force produced by the first treatment ring being rotated, and hence the desired dispersion may be achieved with difficulty. If on the other hand it is more than 800 kPa, the fluid mixture may become hot in excess to affect the fluid mixture adversely. Thus, loading the back pressure within the above range can make more proper the quantity of discharge of the fluid mixture and the degree of dispersion.

The colorant in the second polymerizable-monomer fluid mixture may preferably have a volume-average particle diameter D of:

$0.01\ \mu m < D < 5.00\ \mu m$; and more preferably $0.01\ \mu m < D < 1.00\ \mu m$.

If it has a volume-average particle diameter D of smaller than 0.01 $\mu$m, the second polymerizable-monomer fluid mixture may thicken in excess to have low handling properties. If on the other hand it has a volume-average particle diameter D of larger than 5.00 $\mu$m, a low coloring power may result.

The release agent in the second polymerizable-monomer fluid mixture may also preferably have a volume-average particle diameter D of:

$0.01\ \mu m < D < 5.00\ \mu m$; and more preferably $0.01\ \mu m < D < 1.00\ \mu m$.

If it has a volume-average particle diameter D of smaller than 0.01 $\mu$m, the second polymerizable-monomer fluid mixture may thicken in excess to have low handling properties. If on the other hand it has a volume-average particle diameter D of larger than 5.00 $\mu$m, the release agent can be present in the toner particles with difficulty.

The above fine-dispersion machine may preferably be used when the release agent has a melting point (a peak temperature corresponding to the maximum endothermic peak in the DSC endothermic curve of the release agent) of 90° C. or more and the release agent is finely pulverized in the fluid mixture to make the release agent finely dispersed in the fluid mixture.

In addition to the release agent having a melting point of 90° C. or more, a second release agent having a melting point lower than the melting point 90° C. of the above release agent may preferably be contained as an additive. This is preferable because a toner having the toner particles obtained is remarkably improved in low-temperature fixing performance to transfer materials, and can have a very broad fixing temperature range together with an improvement in high-temperature anti-offset properties.

The process for producing toner particles according to the present invention is also applicable to a process for producing toner particles which is called an emulsification agglomeration process. The process for producing toner particles by emulsification agglomeration is disclosed in Japanese Patent Applications Laid-open No. H10-301333 and No. 2000-81721 (corresponding to U.S. Pat. No. 6,080,519. In the present invention, the colorant is pre-dispersed in an aqueous medium (dispersion medium) in which a surface-active agent stands dissolved, to prepare a first fluid mixture, and the first fluid mixture is introduced into the fine-dispersion machine to disperse the colorant finely to prepare a second fluid mixture. Next, as a second dispersion medium, a fine resin particle dispersion is added to the second fluid mixture to make the colorant and the fine resin particles agglomerate. Thus, toner particles can be obtained in which the colorant stands well finely dispersed in toner particles and has less non-uniformity in colorant content between the toner particles. Preferably, the first dispersion medium comprises water and a surface-active agent and the fine resin particle dispersion comprises a fine resin particle dispersion prepared by emulsion polymerization.

Next, the step of granulation is described below.

Utilizing the principle used in a mechanical seal, the pressure plane between the first treatment ring and the second treatment ring is so set that the second treatment ring presses the first treatment ring, and thereafter a stated pressure applied to a polymerizable monomer composition and an aqueous dispersion medium by means of a machine such as a pump is utilized to make the first treatment ring and the second treatment ring separate. As the result, a fluid film with a microscopic layer thickness can be formed between the first treatment ring and the second treatment ring. Then, a rotary drive mechanism provided in the granulating machine is driven to rotate the first treatment ring relatively to the second treatment ring, whereby a large shear force can be imparted to the polymerizable monomer composition and aqueous dispersion medium within the microscopic interspace between both the treatment rings.

As the result, any highly precise homogeneous granulation action that has not been achievable in the past can be materialized in a short time. A large shear force is applied to the polymerizable monomer composition and aqueous dispersion medium instantaneously at a stated microscopic interspace when they pass between both the treatment rings. Thus, the effect of granulation that has been difficult for conventional granulating machines to obtain can be achieved instantaneously and continuously.

The toner particles obtained through the step of granulation have a sharper particle size distribution than those produced using conventional apparatus. Hence, the step of classification can be omitted, or even through the step of classification, the toner particles can be obtained in a high yield.

The granulating machine may preferably be provided with a cushioning mechanism which cushions any fine vibration or alignment of at least one of the first treatment ring and the second treatment ring. The use of a floating structure provided with the cushioning mechanism in this way enables absorption of alignment such as shaft run-out and enables elimination or restraint of wear due to contact.

The granulating machine may also preferably be provided with a separation stayer which defines the maximum interspace between the first treatment ring and the second treatment ring and stops both the treatment rings from coming more separate than the maximum interspace. This makes it possible to prevent the interspace between the first treatment ring and the second treatment ring from coming larger than is necessary and to carry out uniform granulation treatment surely and smoothly.

The granulating machine may also preferably be provided with an approach stayer which defines the minimum interspace between the first treatment ring and the second treatment ring and stops both the treatment rings from approaching more closely than the minimum interspace. This makes it possible to prevent the interspace between the first treatment ring and the second treatment ring from coming smaller than is necessary and to carry out uniform granulation treatment surely and smoothly.

The granulating machine may also preferably be provided with a jacket for temperature control which controls the temperature of one or both of the first treatment ring and the second treatment ring. Such a jacket for temperature control makes it possible to temperature-control one or both of the first treatment ring and the second treatment ring to temperature suited for carrying out granulation treatment and to carry out granulation treatment in a higher efficiency and a higher precision.

It is also preferable that at least part of one or both of surfaces of the first treatment ring and second treatment ring face has been mirror-finished. Stated specifically, the mirror-finished surface may preferably have a surface roughness Ra of:

$0.01\ \mu m < Ra < 0.50\ \mu m$; and more preferably $0.02\ \mu m < Ra < 0.30\ \mu m$.

Having an Ra of smaller than 0.01 $\mu$m is undesirable because a high working cost may result. Having an Ra of larger than 0.50 $\mu$m is also undesirable because the surface may have a poor contact performance to make the principal of a mechanical seal not act, and makes it impossible to obtain the stated pressure even if a pressure is applied to the fluid mixture by means of a pump or the like, so that the rings can not easily be separated in a proper condition. In virtue of such mirror-finishing, the granulation treatment at the interspace between the first treatment ring and the second treatment ring can be carried out at a higher precision.

The first treatment ring may preferably be rotated at a peripheral speed of from 10 m/s to 100 m/s at its outermost edge. If its peripheral speed is less than 10 m/s, any necessary shear force may not be obtained, resulting in a broad particle size distribution of the toner particles obtained. If on the other hand it is more than 100 m/s, excess centrifugal force may be produced to cause a problem on the stability of the machine.

One or both of the first treatment ring and the second treatment ring may preferably be provided with recesses, and it is preferable to make the second treatment ring separate from the first treatment ring with the rotation of the first treatment ring.

Forming the recesses in the first treatment ring or the second treatment ring or the both of these makes it possible for a granulation fluid to flow through the recesses at the time of rotation to produce dynamic pressure in virtue of the flow of the granulation fluid, where a separating force acts on both treating surfaces to surely form the fluid film with the rotation of the first treatment ring in non-contact with the second treatment ring. Forming such recesses also enhances agitation power to enable more efficient granulation treatment. As the result, highly efficient granulation action can be made to take place instantaneously.

In order to make adjustment of the interspace between the first treatment ring and the second treatment ring in the step of granulation, it is preferable for the second treatment ring to be loaded with a back pressure P of:

$1\ kPa < P < 800\ kPa$.

A back pressure P which is less than 1 kPa is undesirable because the granulation fluid may be discharged in excess from the machine in the step of granulation because of a centrifugal force produced by the first treatment ring being rotated, and hence the desired granulation (making particles finer) may not be achieved. A back pressure P which is more than 800 kPa is also undesirable because the granulation fluid may become hot in excess to affect the granulation fluid adversely. Thus, loading the back pressure within the above range can make more proper the quantity of discharge of the granulation fluid and the degree of making particles finer.

In an embodiment of the process for producing toner particles according to the present invention, it is preferable that a polymerizable monomer composition serving as a disperse phase and an aqueous dispersion medium serving as a continuous phase are held in tanks provided independently from each other, and the both are fed through paths provided independently from each other, to the granulating machine in a stated controlled proportion to form fine particles of the polymerizable monomer composition in the desired particle size in the aqueous dispersion medium, followed by polymerization reaction of the polymerizable monomer present in the finer particles. Continuously carrying out granulation of the polymerizable monomer composition in this way enables control of production cost.

It is also preferable that a polymerizable monomer composition is pre-dispersed in an aqueous dispersion medium in an agitation tank having agitating blades, to obtain a preliminary dispersion, and thereafter the preliminary dispersion is fed to the granulating machine to carry out granulation in order to form fine particles of the polymerizable monomer composition in the desired particle size, followed by polymerization reaction of the polymerizable monomer present in the finer particles. The dispersion having been subjected to granulation, having passed the granulating machine, may preferably be further returned to the agitation tank in order to regulate the particle size distribution of the fine particles of the polymerizable monomer composition in the desired particle size. Circulative treatment of the preliminary dispersion in this way enables more highly efficient granulation.

Figure 5:
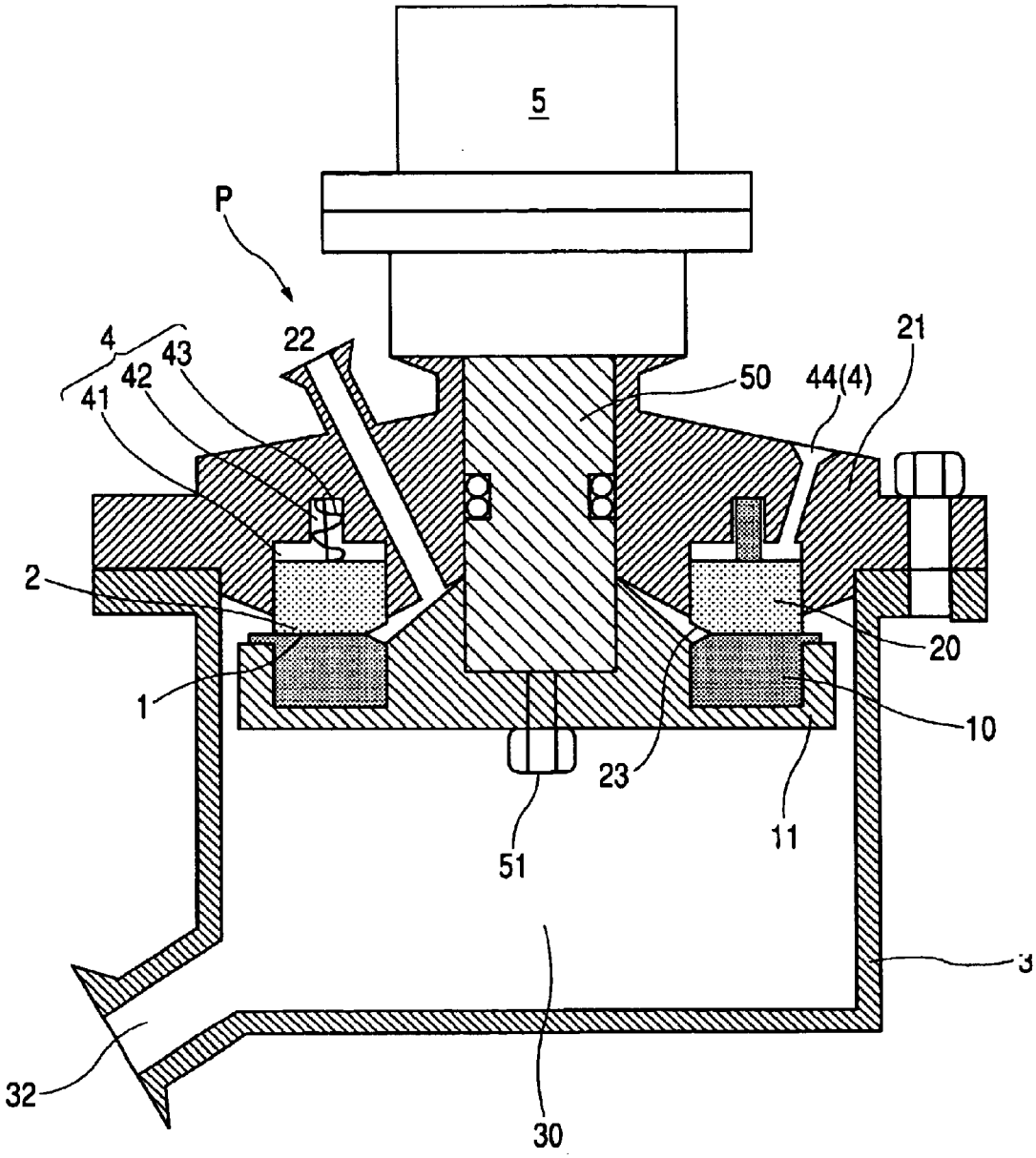
FIG. 5 is a schematic view of a fine-dispersion machine or a granulating machine, used in the present invention.
Figure 6:
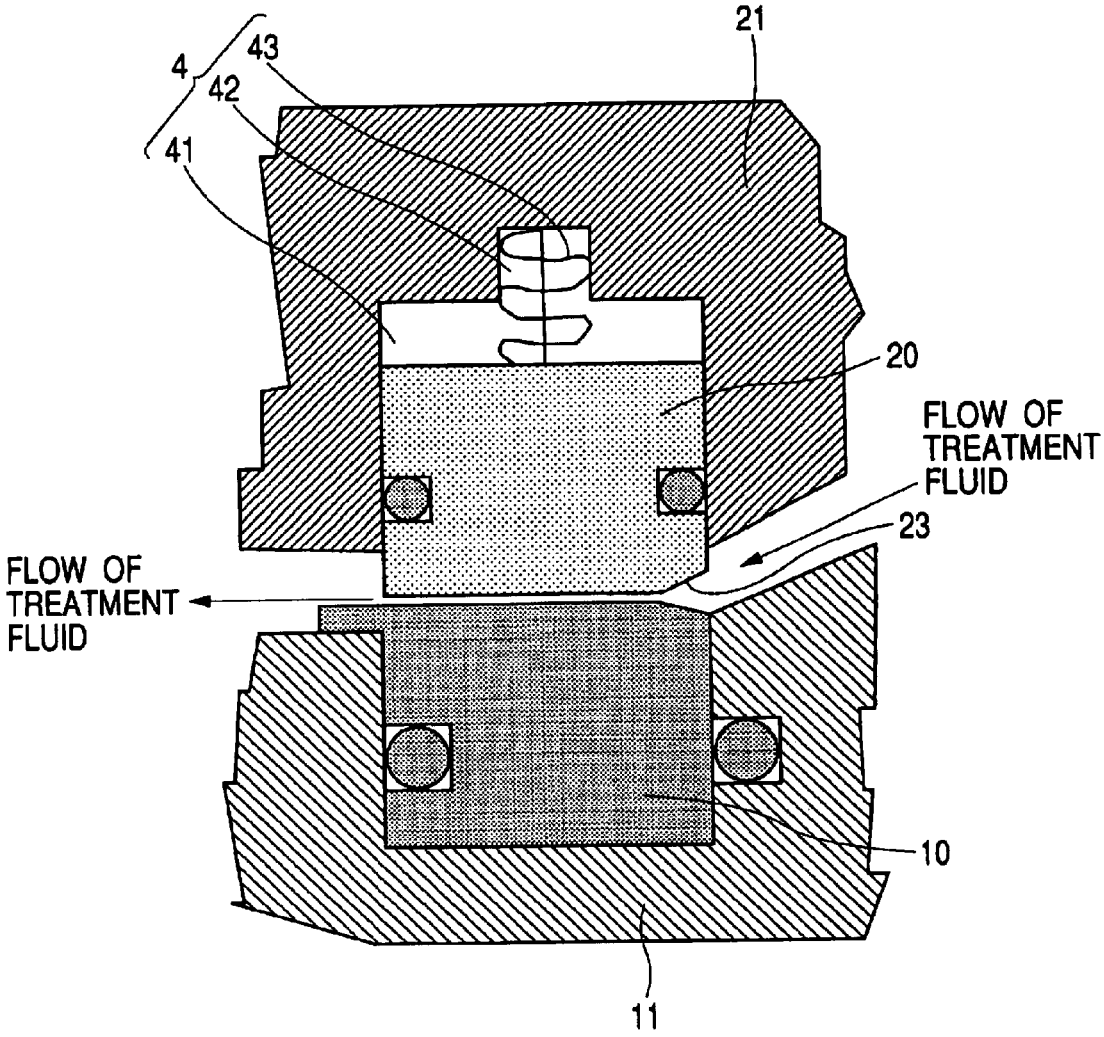
FIG. 6 is a schematic sectional view of the main part of the fine-dispersion machine or granulating machine used in the present invention.
Figure 7:
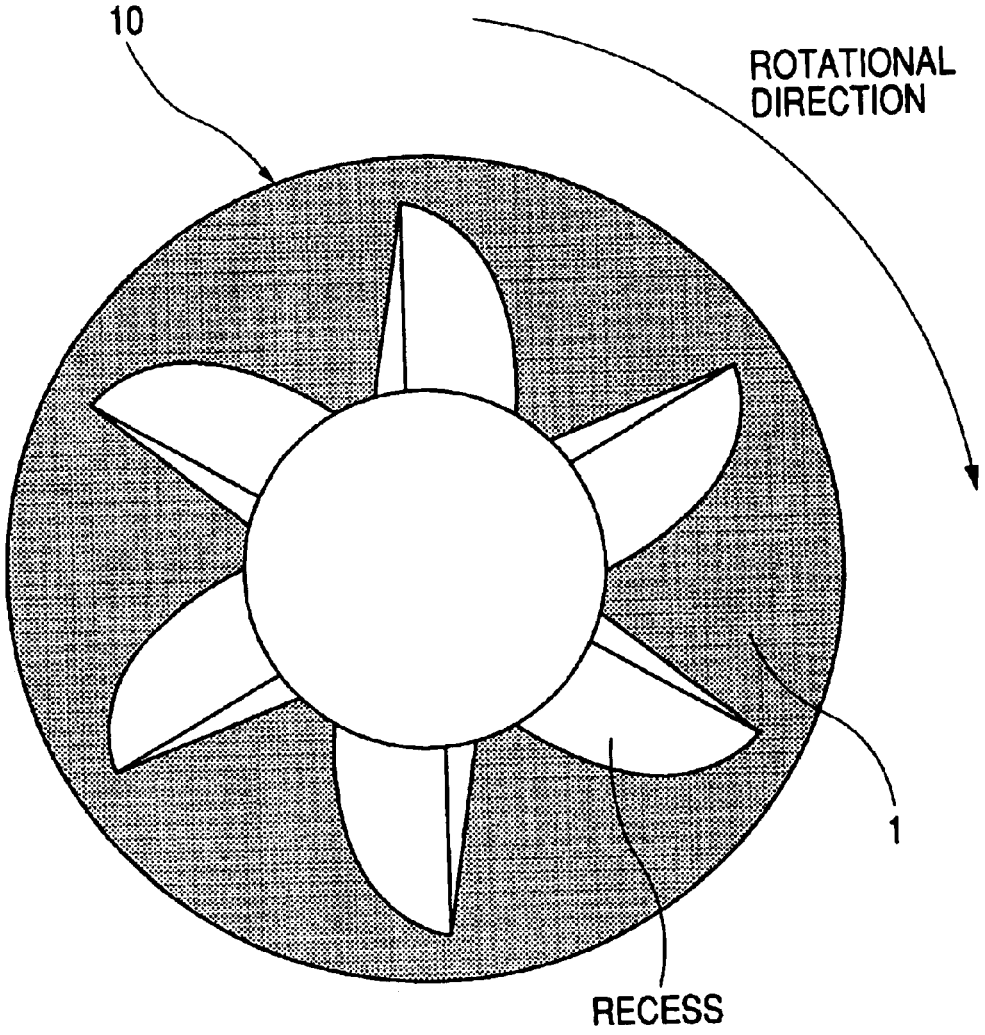
FIG. 7 is a schematic view of the first or second treatment ring of the fine-dispersion machine or granulating machine used in the present invention.

Examples of systems in which the fine-dispersion machine and/or the granulating machine used in the present invention has or have been set are shown in FIGS. 1 to 4. An example of the fine-dispersion machine and/or granulating machine used in the present invention is shown in FIGS. 5 to 7. These show examples, and by no means limit the present invention.

FIG. 5 is a partially cutaway vertical section of the fine-dispersion machine or granulating machine used in the present invention. FIG. 6 is a schematic sectional view of the main part of the dispersion machine or granulating machine shown in FIG. 5. As shown in FIGS. 5 and 6, this dispersion machine or granulating machine has a first holder 11, a second holder 21 provided in front of (or above) the first holder 11, a casing 3 which covers the first holder 11 together with the second holder 21, a feed mechanism P such as a pump, which feeds the fluid mixture or the granulation fluid to the present machine, and a surface contact pressure application mechanism 4. The first holder 11 is provided with a first treatment ring 10 and a rotating shaft 50. The first treatment ring 10 (a mating ring) is an annular member (shown in FIG. 7) made of a metal, and has a mirror-finished first treatment surface 1.

The rotating shaft 50 is, at its lower end, fastened to the center of the first holder 11 by a fastener 51 such as a bolt, and, at its upper end, connected with a rotary derive unit 5 (rotary drive mechanism) such as an electric motor. It transmits the driving force of the rotary derive unit 5 to the first holder 11 to rotate the first holder 11.

The first treatment ring 10 is attached to the front (upper part) of the first holder 11 coaxially with the rotating shaft 50, and is rotated integrally with the first holder 11 as the rotating shaft 50 is rotated. The first treatment surface 1 stands exposed to the surface of the first holder 11 and faces the surface of the second holder 21. This first treatment surface 1 may preferably be mirror-finished by lapping or polishing. The first treatment ring 10 may be made of ceramic, sintered metal, wear-resistant steel, and besides a metal having been subjected to hardening treatment or to which lining or coating of a hard material has been applied, any of which may preferably be used. The first treatment ring 10 may preferably be formed using a light-weight material especially because it is rotated.

The casing 3 is a closed-end container having a discharge port 32. In its internal space 30, the first holder 11 is held.

The second holder 21 is provided with a second treatment ring 20, a feed port 22 through which the fluid mixture or granulation fluid is introduced, and the surface contact pressure application mechanism 4. The second treatment ring 20 (a compression ring) is an annular member made of a metal, is set stationary, and has a mirror-finished second treatment surface 2 and a pressure plane (pressure-receiving plane) 23 positioned inside the second treatment surface 2 and adjoining to the second treatment surface 2 (hereinafter "separation control surface 23"). As shown in FIG. 5, this separation control surface 23 is formed to have a slope.

The second treatment surface 2 may be mirror-finished by the same method as that for the first treatment surface 1. The second treatment ring 20 may also be made of the same material as that for the first treatment ring 10. The separation control surface 23 adjoins the inner peripheral surface of the annular second treatment ring 20.

The surface contact pressure application mechanism 4 presses the second treatment surface 2 against the first treatment surface 1 to make the former kept in pressure contact with or proximity to the latter, and maintains a balance with the force acting to make both the treatment surfaces 1 and 2 separate by the aid of fluid pressure (the pressure against the fluid mixture or granulation fluid that is produced by a feed mechanism such as a pump), to form a thin fluid film between them. In other words, the thin fluid film maintains the interspace between both the treatment surfaces 1 and 2 to the microscopic interspace.

Stated specifically, in this embodiment, the surface contact pressure application mechanism 4 is constituted of a holding space 41, a spring-receiving space 42 provided at the inner part (inmost part) of the holding space 41, a spring 43 and an air feed port 44.

In the holding space 41, the second treatment ring 20 is so fitted that the position of the second treatment ring 20 in the holding space 41 can be changed to a deep or narrow position (to an upper or lower position). One end of the spring 43 is in contact with the inner part of the spring-receiving space 42, and the other end of the spring 43 is in contact with the front part (upper part) of the second treatment ring 20 fitted in the spring-receiving space 42. In FIG. 5, only one spring 43 is drawn, but it is preferable to provide a plurality of springs so as to press the second treatment ring 20 at a plurality of positions. This is because the use of the spring 43 in a larger number enables more uniform pressure (pressing force) to be applied to the second treatment ring 20. Accordingly, in respect of the second holder 21, it may preferably be fitted with several to tens of springs 43 (more preferably from 4 to 20 springs).

In the fine-dispersion machine or granulating machine shown in FIG. 5, a pressure gas such as compressed air can be introduced into the holding space 41 through the air feed port 44 described above. By introducing the pressure gas such as compressed air, air pressure can be imparted as pressing force to the second treatment ring 20 together with the pressure of the spring 43, using the space between the holding space 41 and the second treatment ring 20 as a pressure chamber. Accordingly, the pressure of the air introduced through the air feed port 44 may be controlled so that the surface contact pressure of the second treatment surface 2 against the first treatment surface 1 can also be controlled during drive. In place of the introduction of air that utilizes air pressure, other fluid pressure such as oil pressure may also be utilized.

The surface contact pressure application mechanism 4 feeds and controls part of the above pressing force (surface contact pressure) and, besides that, serves also as a displacement control mechanism and a cushioning mechanism. Stated in detail, the surface contact pressure application mechanism 4, as a displacement control mechanism, can follow up, by controlling air pressure, any elongation in axial direction that may be caused at the start of drive or during drive or any displacement in axial direction that may be caused by wear, to maintain the original pressing force. The surface contact pressure application mechanism 4 also functions as a cushioning mechanism as mentioned above, against any fine vibration or rotational alignment by employing a floating mechanism which holds the second treatment ring 20 displaceably.

In the surface contact pressure application mechanism 4, the spring 43 also defines the upper limit of the range of the interspace between the first treatment surface 1 and the second treatment surface 2 even where there is space between the top of the second treatment ring 20 in the holding space 41 and the uppermost part of the holding space 41. The surface contact pressure application mechanism 4 functions as a separation stayer which stops the first treatment surface 1 and the second treatment surface 2 from separating beyond what has been defined.

Even where the first treatment surface 1 and the second treatment surface 2 do not stand in contact, the spring 43 defines the lower limit of the range of the interspace between the first treatment surface 1 and the second treatment surface 2. The surface contact pressure application mechanism 4 functions as an approach stayer which stops the first treatment surface 1 and the second treatment surface 2 from approaching beyond what has been defined.

As shown in FIG. 7, the first treatment ring 10 may be provided with recesses in a radial form. If necessary, the recesses may be provided in the second treatment ring 20, or in both the treatment rings 10 and 20. Forming the recesses in this way makes it possible for the fluid mixture or granulation fluid to flow through the recesses at the time of rotation to produce dynamic pressure in virtue of the flow of the fluid mixture or granulation fluid, where a separating force acts on both the first treatment surface 1 and the second treatment surface 2 to surely form a more favorable fluid film with the rotation of the first treatment ring 10 in non-contact with the second treatment ring 20. This also enhances agitation power to enable more efficient dispersion treatment or granulation treatment.

Such fine-dispersion machine and granulation machine may include, e.g., CLEAR SS5 (RUBBY MILL), manufactured by M. Technique K.K.

A case in which the apparatus according to the present invention is used as the fine-dispersion machine is described below in greater detail.

In a system for producing toner particles as shown in FIG. 1, a first polymerizable-monomer fluid mixture prepared by pre-dispersing a colorant or a release agent or a mixture of these in a dispersion medium (e.g., a polymerizable monomer) in a pre-dispersion step (not shown) is introduced into a dispersion step 61 to finely disperse the colorant or the release agent or the mixture of these in the dispersion medium by means of the above fine-dispersion machine to prepare a second polymerizable-monomer fluid mixture.

Next, in a dissolution step 62, at least one additive is optionally added to the second polymerizable-monomer fluid mixture obtained. Then, in a granulation step 63, the second polymerizable-monomer fluid mixture is granulated, and, in a polymerization step 64, the polymerizable monomer present in the resultant particles of the polymerizable-monomer fluid mixture or polymerizable monomer composition is polymerized to obtain toner particles. Thereafter, in a post step 65, a toner is obtained from the toner particles.

In the above dispersion step 61, the first polymerizable-monomer fluid mixture, having been prepared in a stated quantity, is introduced from the feed mechanism P under a constant feed pressure into the internal space of the closed casing 3 through the feed port 22. However, the first polymerizable-monomer fluid mixture may be introduced through a plurality of paths, and a liquid(s) or a solid(s) may be introduced through paths different from one another. Meanwhile, the first treatment ring 10 is rotated by the rotary derive unit 5 (rotary drive mechanism). Thus, the first treatment surface 1 is rotated relatively to the second treatment surface 2 in the state the former keeps a microscopic interspace to the latter.

The first polymerizable-monomer fluid mixture introduced into the internal space of the casing 3 comes to form a fluid film between the first treatment surface 1 keeping the microscopic interspace and the second treatment surface 2, where the fluid film undergoes strong shear between the first treatment surface 1 and the second treatment surface 2 as the former is rotated. Thus the second polymerizable-monomer fluid mixture is obtained in which the colorant or the release agent or the mixture of these have been dispersed as desired. The second polymerizable-monomer fluid mixture thus obtained is discharged through the discharge port 32, and sent to the next step dissolution step 62. Thereafter, in the polymerization step 64, toner particles are directly formed by the suspension polymerization process disclosed in Japanese Patent Publication No. S36-10231, Japanese Patent Application Laid-open No. S59-53856 or Japanese Patent Application Laid-open No. S59-61842.

Figure 2:
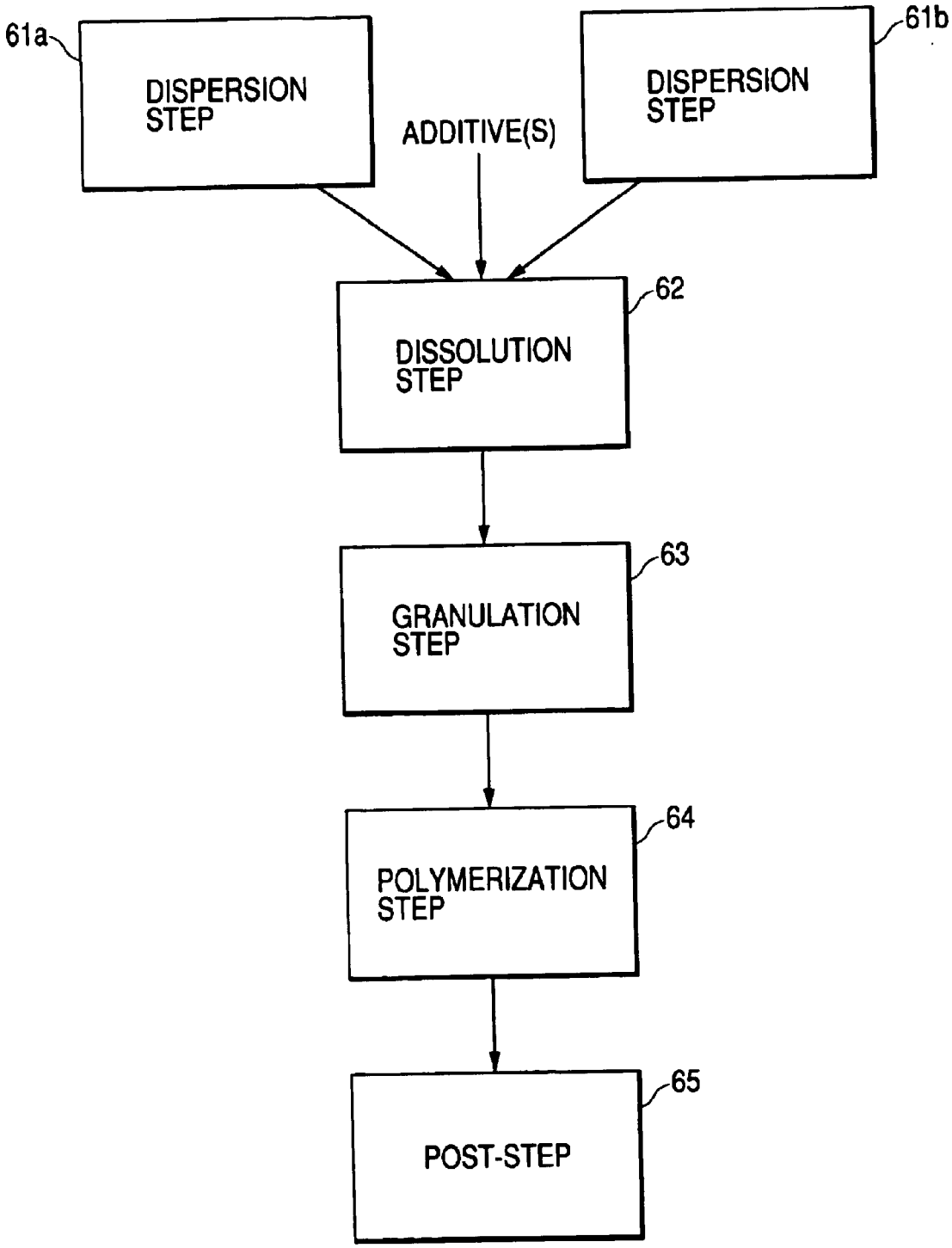
FIG. 2 is a diagram showing another example of a system in which a fine-dispersion machine used in the present invention has been set.

An example of a system for producing toner particles in a case in which the colorant and the release agent are treated in different fine-dispersion machines is shown in FIG. 2. In the system shown in FIG. 2, a first fluid mixture prepared by pre-dispersing the colorant in a pre-dispersion step (not shown) is introduced into a dispersion step 61*b*. The dispersion step 61*b* is the step of dispersing in a polymerizable monomer at least the colorant into fine particles to have a stated particle diameter to obtain a second polymerizable-monomer fluid mixture having the colorant. Another first fluid mixture prepared by pre-dispersing the release agent in a pre-dispersion step (not shown) is introduced into a dispersion step 61*a*. The dispersion step 61*a* is the step of dispersing at least the release agent in a polymerizable monomer to prepare a second polymerizable-monomer fluid mixture having a finely particulate release agent. To the second polymerizable-monomer fluid mixtures obtained in the dispersion step 61*a* and the dispersion step 61*b*, at least one additive is added in a dissolution step 62 to prepare a polymerizable monomer composition. Then, in a granulation step 63, the polymerizable monomer composition is granulated in an aqueous dispersion medium, and, in a polymerization step 64, the polymerizable monomer present in the resultant particles of the polymerizable monomer composition is polymerized to obtain toner particles. Thereafter, in a post step 65, a toner is obtained from the toner particles.

In this system for producing toner particles, the dispersion step is divided into two steps, but is by no means limited to this. At least, the fine-dispersion machine according to the present invention may be used in the dispersion step 61.

A case in which the apparatus according to the present invention is used as the granulating machine is described below in greater detail.

Figure 3:
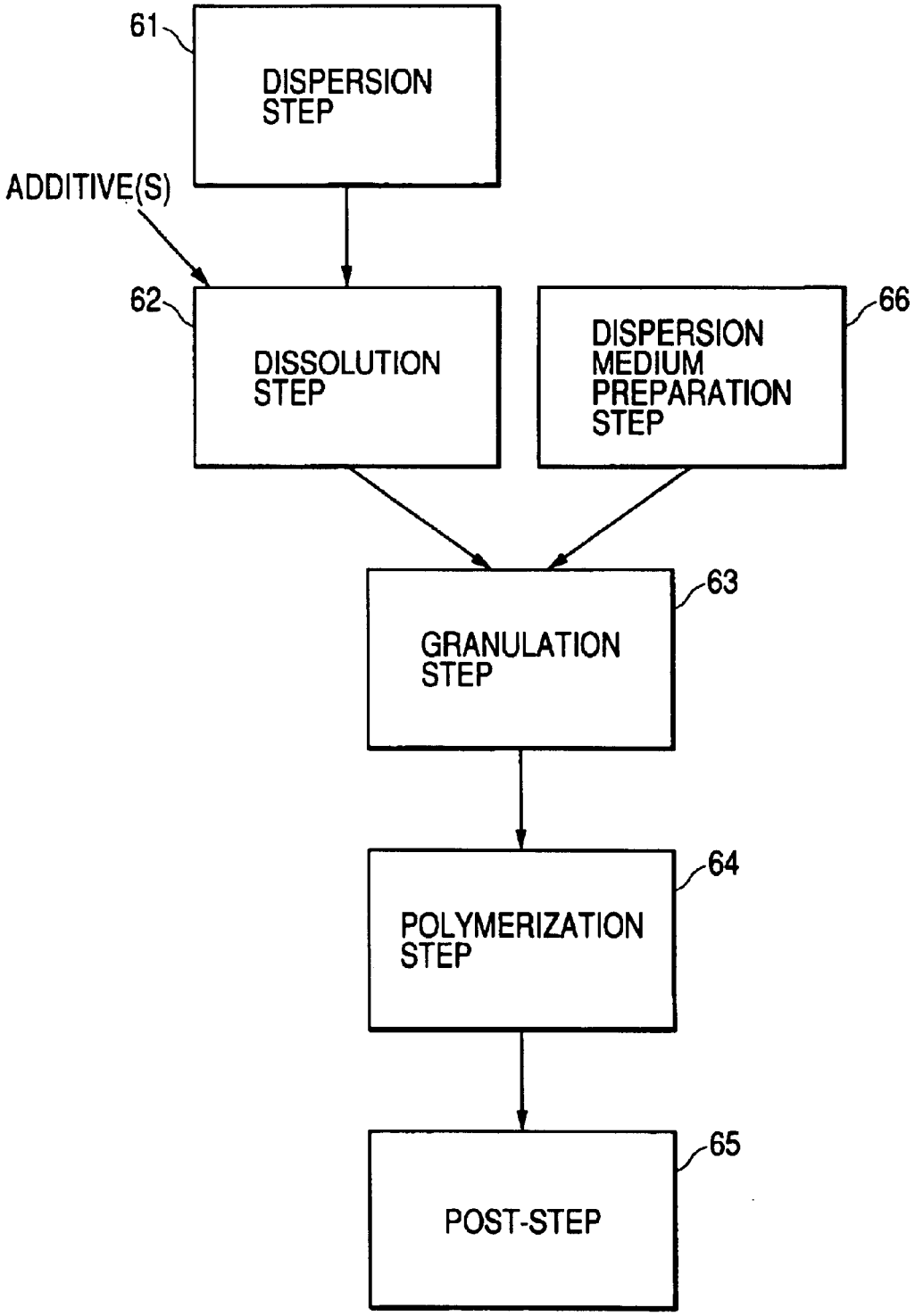
FIG. 3 is a diagram showing an example of a system in which a granulating machine used in the present invention has been set.

In a system shown in FIG. 3, a polymerizable monomer mixture containing a finely particulate colorant or release agent or a mixture of these is obtained in a dispersion step 61. Thereafter, in a dissolution step 62, at least one additive is added to the polymerizable monomer mixture to obtain a polymerizable monomer composition. On the one hand, in an aqueous dispersion medium preparation step 66, the desired aqueous dispersion medium is obtained. Thereafter, in a granulation step 63 in which the granulating machine according to the present invention has been installed, the polymerizable monomer composition and the aqueous dispersion medium are introduced into the granulating machine by means of the feed mechanism P in a stated proportion. On the other hand, the first treatment ring 10 is rotated by the rotary derive unit 5 (rotary drive mechanism). Thus, the first treatment surface 1 is rotated relatively to the second treatment surface 2 in the state the former keeps a microscopic interspace to the latter.

The polymerizable monomer composition and the aqueous dispersion medium introduced into the internal space of the casing 3 comes to form a fluid film between the first treatment surface 1 keeping the microscopic interspace and the second treatment surface 2, where the fluid film undergoes strong shear between the first treatment surface 1 and the second treatment surface 2 as the former is rotated, so that the polymerizable monomer composition is made into fine particles with the desired particle diameters in the aqueous dispersion medium. The resultant fine particles of the polymerizable monomer composition are thereafter come to be stable fine particles in virtue of the effect brought by the dispersant contained in the aqueous dispersion medium. A slurry containing these fine particles is discharged through the discharge port 32, and sent to the next step polymerization step 64. Thereafter, toner particles are directly formed by the suspension polymerization process disclosed in Japanese Patent Publication No. S36-10231, Japanese Patent Application Laid-open No. S59-53856 or Japanese Patent Application Laid-open No. S59-61842. Thereafter, in a post step 65, a toner is obtained from the toner particles.

Figure 4:
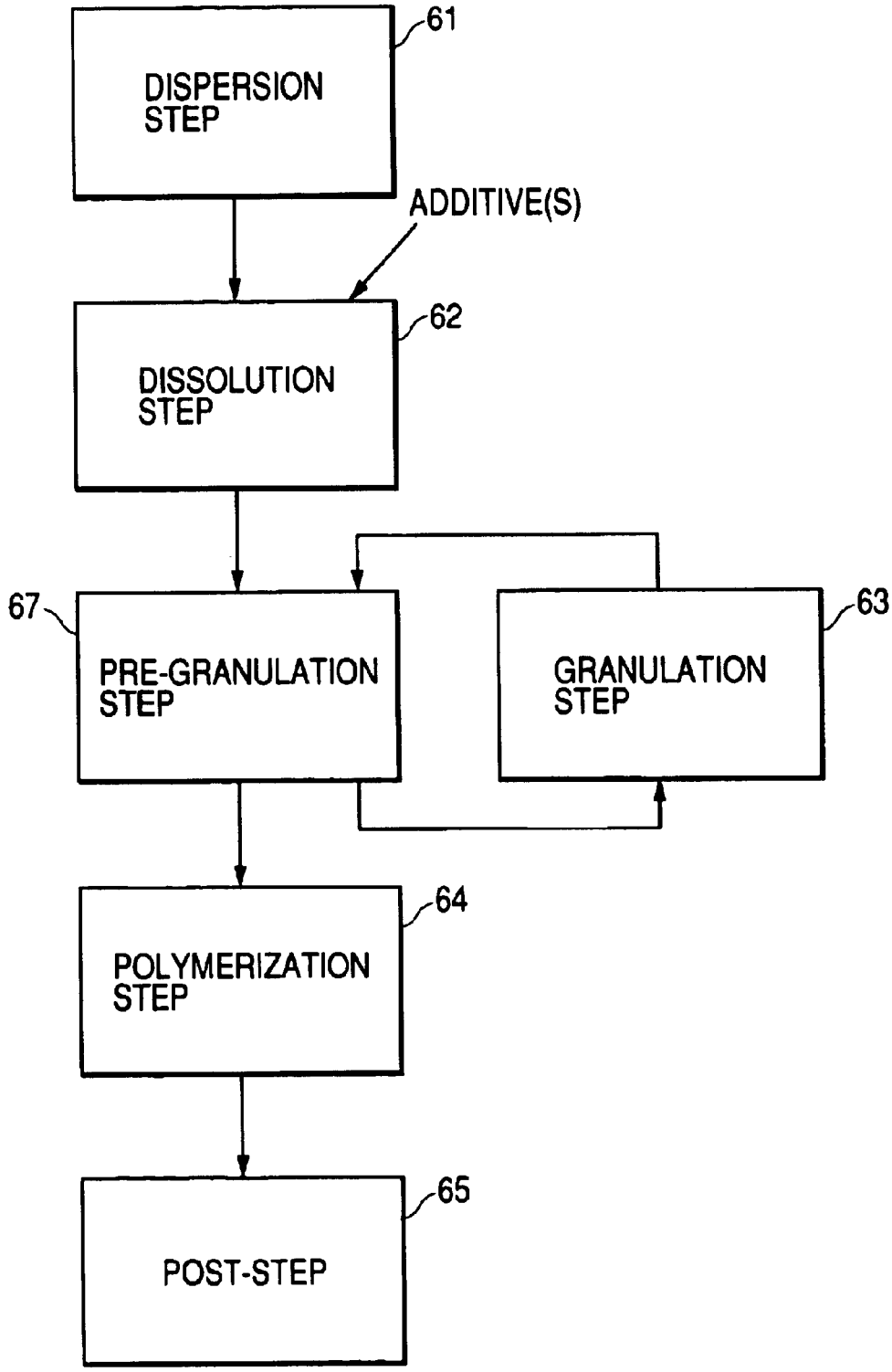
FIG. 4 is a diagram showing an example of a system in which a granulating machine used in the present invention has been set.

As also shown in FIG. 4 as an example of a system for producing toner particles, in a pre-granulation step 67*a* polymerizable monomer composition may beforehand simply be agitated in an aqueous dispersion medium in a container having agitating blades, and thereafter the polymerizable monomer composition and aqueous dispersion medium simply agitated may be fed by the feed mechanism P to a granulation step 63 making use of the granulating machine according to the present invention. The slurry discharged through the discharge port 32 of the granulating machine may further be introduced to the pre-granulation step 67. In the example of the toner particle production system shown in FIG. 4 as well, after the desired toner particles of the polymerizable monomer composition has been obtained, they are sent to the next step polymerization step 64. Thereafter, toner particles are directly formed by the suspension polymerization process disclosed in Japanese Patent Publication No. S36-10231, Japanese Patent Application Laid-open No. S59-53856 or Japanese Patent Application Laid-open No. S59-61842. Thereafter, in a post step 65, a toner is obtained from the toner particles.

In the dissolution step 62, the polymerization step 64 and the aqueous dispersion medium preparation step 66, apparatus which can agitate the whole interiors of containers are preferable as agitators used. For example, the agitators may include paddle blades, and anchor blades, and preferably FULL-ZONE blades (manufactured by Shinko Pantekku K.K.), MAXBLEND blades (manufactured by Sumitomo Heavy Industries, Ltd.), SANMELER blades (manufactured by Mitsubishi Heavy Industries, Ltd.), HI-F mixer blades (manufactured by Soken Chemical & Engineering Co., Ltd.), BENDLEAF blades (manufactured by Hakko Sangyo K.K.), and DISSOLVER blades (manufactured by M. Technique K.K.).

The toner particles obtained may also preferably be toner particles made to have a core/shell structure the shell of which has been formed by polymerization so as to achieve both fixing performance and anti-blocking properties. When such toner particles are produced, it is important that the release agent is made present in substantially the same proportion in individual toner particles. Accordingly, it is important to control the dispersibility of release agents and control the particle size distribution at the time of granulation. In the production process of the present invention, it is possible to achieve the dispersibility of release agents that is not achievable in other colloid mills or roll mills, and to make the particles of the liquid polymerizable monomer composition have a sharp particle size distribution when granulated in the aqueous dispersion medium. Hence, the release agent can be made present in substantially the same proportion in individual toner particles.

As a main component of the core, it may preferably be the release agent. As the release agent, it is preferable to use a compound having a melting point (peak temperature of a maximum endothermic peak in the endothermic curve) of from 40 to 150° C. in the DSC curve as measured according to ASTM D3418-8. If the release agent has a melting point of less than 40° C., it may have a weak self-cohesive force, undesirably resulting in weak high-temperature anti-offset properties when toner images are fixed by heat and pressure. If on the other hand it has a melting point of 150° C. or more, the toner may have a high fixing temperature undesirably. Also, if the maximum endothermic peak is at a high temperature, the release agent may undesirably precipitate during granulation.

In order to achieve both low-temperature fixing performance and high-temperature anti-offset properties to make the low-temperature fixing performance and the high-temperature anti-offset properties functionally separate, it is also preferable to use the release agent in plurality, a low-melting release agent and a high-melting release agent. As the low-melting release agent, preferred is a release agent having a melting point of from 40° C. or more to less than 90° C. As the high-melting release agent, preferred is a release agent having a melting point of from 90° C. to 150° C. A release agent which does not dissolve within the temperature range in the production process of the present invention may preferably be finely pulverized and dispersed in the polymerizable monomer especially by means of the fine-dispersion machine according to the present invention.

In the present invention, the melting point of the release agent is measured using, e.g., DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of heating of 10° C./min.

As the release agent, wax of various types may be used. The wax may include aliphatic hydrocarbon waxes such as low-molecular weight polyethylene, polyolefin copolymers, polyolefin wax, microcrystalline wax, paraffin wax and Fischer-Tropsh wax.

It may further includes oxides of aliphatic hydrocarbon waxes, such as polyethylene oxide wax; or block copolymers of these; vegetable waxes such as candelilla wax, carnauba wax, japan wax (haze wax) and jojoba wax; animal waxes such as bees wax, lanolin and spermaceti; mineral waxes such as ozokelite, serecin and petrolatum; waxes composed chiefly of a fatty ester, such as montanate wax and caster wax; and waxes having a functional group, e.g., waxes obtained by subjecting part or the whole of a fatty acid to deoxydation, such as deoxidized carnauba was.

It may still further include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also alkyl alcohols having a long-chain alkyl group; polyhydric alcohols such as sorbitol; fatty acid amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as such as m-xylenebisstearic acid amide and N,N'-distearylisophthalic acid amide; fatty acid metal salts (those commonly called metal soap) such as calcium stearate, calcium laurate, zinc stearate and magnesium stearate; partially esterified products of polyhydric alcohols with fatty acids, such as monoglyceride behenate; and methyl ester compounds having a hydroxyl group, obtained by hydrogenation of vegetable fats and oils.

As a wax grafted with a vinyl monomer, it may include waxes obtained by grafting aliphatic hydrocarbon waxes with vinyl monomers such as styrene or acrylic acid.

Preferred waxes may include polyolefins obtained by radical-polymerizing olefins under high pressure; polyolefins obtained by purifying low-molecular-weight by-products formed at the time of the polymerization of high-molecular-weight polyolefins; polyolefins obtained by polymerization under low pressure in the presence of a catalyst such as a Ziegler catalyst or a metallocene catalyst; polyolefins obtained by polymerization utilizing radiations, electromagnetic waves or light; paraffin wax, microcrystalline wax, and Fischer-Tropsh wax; synthetic hydrocarbon waxes obtained by the Synthol method, the Hydrocol process or the Arge process; synthetic waxes comprised, as a monomer, of a compound having one carbon atom; hydrocarbon waxes having a functional group such as a hydroxyl group, a carboxyl group or an ester group; mixtures of hydrocarbon waxes and hydrocarbon waxes having a functional group; and modified waxes obtained by grafting to any of these waxes serving as a matrix, vinyl monomers such as styrene, maleate, acrylate, methacrylate or maleic anhydride.

Also preferably usable are any of these waxes having been made to have sharp molecular weight distribution by press sweating, solvent fractionation, recrystallization, vacuum distillation, ultracritical gas extraction or molten liquid crystallization, and those from which low-molecular-weight solid fatty acids, low-molecular-weight solid alcohols, low-molecular-weight solid compounds and other impurities have been removed.

The release agent may preferably be added to the toner particles in an amount of from 5 to 30% by weight. Its addition in an amount of less than 5% by weight may makes it difficult to achieve good fixing performance and anti-offset properties. Also, its addition in an amount of more than 30% by weight tends to cause mutual coalescence of toner particles at the time of granulation even when produced by polymerization, tending to result in formation of toner particles having a broad particle size distribution.

As a method for encapsulating the release agent into the toner particles, the polarities of materials in the aqueous medium are so set that the polarity of the release agent is smaller than that of the main polymerizable monomer, and also a resin or monomer having a great polarity may be added in a small quantity, whereby toner particles can be obtained which have a core/shell structure wherein the release agent is covered with the resin. The particle size distribution and particle diameter of the toner particles may be controlled by changing the type or amount of a sparingly water-soluble inorganic salt or a dispersion stabilizer having the action of protective colloids, or controlling drive conditions of the apparatus set in the step of granulation or the concentration of solid matter in the aqueous medium, whereby toner particles can be obtained which have a stated average particle diameter in a stated particle size distribution.

The polymerizable monomer used in the present invention may include styrene; styrene monomers such as o-, m- or p-methylstyrene, and m- or p-ethylstyrene; acrylic or methacrylic ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide. Any of these polymerizable monomers may be used alone or in the form of a mixture.

Any of these polymerizable monomers may usually be used in the form of an appropriate mixture of monomers so mixed that the theoretical glass transition temperature (Tg) as described in a publication POLYMER HANDBOOK, 2nd Edition, pp. 139–192 (John Wiley & Sons, Inc.) ranges from 40 to 80° C. If the theoretical glass transition temperature is less than 40° C., the toner may have low storage stability or running stability. If on the other hand the theoretical glass transition temperature is more than 80° C., the fixing temperature may come higher. Especially in the case of full-color toners, the color mixing performance of the respective color toners tend to lower, and also the transparency of OHP images tends to lower.

Molecular weight of the shell (shell resin) of the toner particles having core/shell structure may be measured by gel permeation chromatography (GPC). As a specific method for measurement by GPC, the toner or toner particles is/are beforehand extracted with a toluene solvent for 20 hours by means of a Soxhlet extractor, and thereafter the toluene is evaporated by means of a rotary evaporator, followed by addition of an organic solvent (e.g., chloroform) capable of dissolving the release agent but dissolving no shell resin, to thoroughly carry out washing. Thereafter, the solution is dissolved in tetrahydrofuran (THF), and then filtered with a solvent-resistant membrane filter of 0.3 $\mu$m in pore diameter to obtain a sample. Molecular weight distribution of the sample may be measured using a DETECTOR 150C, manufactured by Waters Co. As column constitution, A-801, A-802, A-803, A-804, A-805, A-806 and A-807, available from Showa Denko K.K., are connected, and the molecular weight distribution is measured using a calibration curve of a standard polystyrene resin. The shell resin ay preferably have a number-average particle diameter (Mn) of from 5,000 to 1,000,000 and may have a ratio of weight-average particle diameter (Mw) to number-average particle diameter (Mn), Mw/Mn, of from 2 to 100, and preferably from 4 to 100.

In the present invention, when the toner particles having core/shell structure are produced, it is particularly preferable to further add, in addition to the shell resin, a polar resin in order for the release agent to be encapsulated in the shell resin. As the polar resin used in the present invention, copolymers of styrene with acrylic or methacrylic acid, maleic acid copolymers, saturated polyester resins and epoxy resins may preferably be used. The polar resin may particularly preferably be one not containing in the molecule any unsaturated groups that may react with the shell resin or the monomer. When a polar resin containing such reactive unsaturated groups is contained, cross-linking reaction may take place between the polar resin and the monomer that forms the shell resin layer, so that a high-molecular weight component and/or a THF-insoluble component may be formed, and the toner may have a high molecular weight for full-color toners. This is undesirable as full-color toners.

In the present invention, the surfaces of the toner particles having the core/shell structure may be further provided with outermost shell resin layers. It is preferable that such outermost shell resin layers have a glass transition temperature so set as to be higher than the glass transition temperature of the shell resin layer in order to more improve anti-blocking properties, and further have been cross-linked to such an extent that the fixing performance is not damaged. The outermost shell resin layers may preferably be further incorporated with a polar resin or a charge control agent in order to improve charging performance.

There are no particular limitations on how to provide the outermost shell resin layers. For example, the layers may be provided by a method including the following.

1) A method in which, at the latter half or after the completion of polymerization reaction, a monomer in which the polar resin, a charge control agent and a cross-linking agent as occasion calls have been dissolved or dispersed is added to an aqueous medium in which the toner particles are present, and is adsorbed on the toner particles, followed by addition of a polymerization initiator to carry out polymerization.
2) A method in which emulsion polymerization particles or soap-free polymerization particles formed of a monomer containing the polar resin, a charge control agent and a cross-linking agent as occasion calls are added to an aqueous medium in which the toner particles are present, and are caused to cohere to the surfaces of toner particles, optionally further followed by heating to fix them.
3) A method in which emulsion polymerization particles or soap-free polymerization particles formed of a monomer containing the polar resin, a charge control agent and a cross-linking agent as occasion calls are mechanically caused to fix to the surfaces of toner particles by a dry process.

As the colorant used in the present invention, carbon black, a black organic pigment or a magnetic material is used as a black colorant. In the case of non-magnetic black toner particles, carbon black may preferably be used as the colorant.

In the case when a magnetic material is used as a black colorant, any of magnetic materials as exemplified below may be used. In this case, the magnetic material to be incorporated in magnetic toner particles may include iron oxides such as magnetite, maghematite and ferrite, and iron oxides including other metal oxides; and metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of the above magnetic materials may be used alone or in combination of two or more types.

As the particle shape of these magnetic materials, it may be octahedral, hexahedral, spherical, acicular or flaky. Those having less anisotropy, such as octahedral, hexahedral or spherical ones are preferred in view of providing high image density.

In the case when the magnetic material is thus used as a black colorant, it may be used in an amount of from 40 to 150 parts by weight based on 100 parts by weight of the polymerizable monomer or the resin unlike other non-magnetic colorants.

It is preferable that the particle surfaces of the magnetic material have been subjected to hydrophobic treatment.

When the particle surfaces of the magnetic material are made hydrophobic, a method may be used which makes surface treatment in an aqueous medium while dispersing the magnetic material so as to have a primary particle diameter and hydrolyzing a coupling agent. The use of this method is particularly preferable because the particle surfaces of the magnetic material can uniformly and appropriately be made hydrophobic. This method of hydrophobic treatment in water or an aqueous medium may less cause the mutual coalescence of magnetic material particles than any method of dry-process treatment made in a gaseous phase. Also, charge repulsion acts between magnetic material particles themselves as a result of hydrophobic treatment, so that the magnetic material particles are surface-treated substantially in the state of primary particles.

The method of surface-treating the magnetic material particles while hydrolyzing the coupling agent in an aqueous medium does not require any use of coupling agents which may generate gas, such as chlorosilanes and silazanes, and also enables use of highly viscous coupling agents which tend to cause mutual coalescence of magnetic material particles in a gaseous phase and hence have ever made it difficult to make good treatment. Thus, a great effect of making hydrophobic is obtainable.

Where the particles of magnetic material are used as a colorant, the coupling agent usable in their surface treatment may include, e.g., silane coupling agents and titanium coupling agents. Preferably usable are silane coupling agents, which are those represented by the general formula:

$$R_mSiY_n$$

wherein R represents an alkoxyl group; m represents an integer of 1 to 3; Y represents a hydrocarbon group such as an alkyl group, a vinyl group, a glycidoxyl group or a methacrylic group; and n represents an integer of 1 to 3.

Such silane coupling agents may include, e.g., vinyltrimethoxysilane, vinyltriethoxysilane, vinyltris($\beta$-methoxyethoxy)silane, $\beta$-(3,4-epoxycyclohexyl) ethyltrimethoxysilane, $\gamma$-glycidoxypropyltrimethoxysilane, $\gamma$-glycidoxypropylmethyldiethoxysilane, $\gamma$-aminopropyltriethoxysilane, N-phenyl-$\gamma$-aminopropyltrimethoxysilane, $\gamma$-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

Of these, silane coupling agents having a double bond may preferably be used in order to improve the dispersibility of the magnetic material, and more preferred are phenyltrimethoxysilane, $\gamma$-methacryloxypropyltrimethoxysilane and $\gamma$-glycidoxypropyltrimethoxysilane. This is considered due to the fact that particularly in case of suspension polymerization, the treatment with the coupling agent having a double bond makes the magnetic material well fit the polymerizable monomer. This improves the dispersibility of the magnetic material in the toner particles.

The following colorants may also be used.

As yellow colorants, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are preferred.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may preferably be used.

In the case of color toners, the colorants are selected taking account of hue angle, chroma, brightness, weatherability, transparency on OHP films and dispersibility in toner particles. A non-magnetic colorant may preferably be used adding it in an amount of from 1 to 20 parts by weight based on 100 parts by weight of the polymerizable monomer or the resin.

As the charge control agent used in the present invention, known agents may be used. In the case of color toners, it is particularly preferable to use charge control agents that are colorless, make toner charging speed higher and are capable of stably maintaining a constant charge quantity. Also, charge control agents having no polymerization inhibitory action and having no solubilisate in the aqueous medium are particularly preferred. They may include, as negative charge control agents, metal compounds of salicylic acid, dialkylsalicylic acids, naphthoic acid or dicarboxylic acids; polymer type compounds having sulfonic acid and/or carboxylic acid in the side chain; and boron compounds, urea compounds, silicon compounds and carixarene. As positive charge control agents, they may include quaternary ammonium salts, polymer type compounds having such a quaternary ammonium salt in the side chain, guanidine compounds and imidazole compounds.

Any of these charge control agent may preferably be used in a amount of from 0.5 to 10 parts by weight based on 100 parts by weight of the polymerizable monomer or the resin. In the present invention, the addition of the charge control agent is not essential. In the case of toners for two-component development, the triboelectric charging between the toner and a carrier may be utilized. In the case of non-magnetic one-component development, the triboelectric charging between the toner and a blade-coating blade member or sleeve member may be utilized. Thus, the charge control agent need not necessarily be contained in the toner particles.

The polymerization initiator used in the present invention may include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxydiethylhexanoate and t-butyl peroxypivalate. The polymerization initiator may commonly be used in an amount of from 0.5 to 20% by weight, preferably 0.5 to 5% by weight based on the weight of the polymerizable monomer, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added.

The cross-linking agent may include, as aromatic divinyl compounds, divinylbenzene and divinylnaphthalene; as diacrylate compounds linked with an alkyl chain, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moieties have been replaced with methacrylate; as diacrylate compounds linked with an alkyl chain containing an ether bond, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moieties have been replaced with methacrylate; as diacrylate compounds linked with a chain containing an aromatic group and an ether linkage, polyoxythylene(2)-2,2-bis(4-hydroxyphenyl)propane diacrylate, polyoxythylene(4)-2,2-bis(4-hydroxyphenyl)propane diacrylate, and the above compounds whose acrylate moieties have been replaced with methacrylate; and, as polyester type diacrylate compounds, MANDA (trade name; available from Nippon Kayaku Co., Ltd.).

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moieties have been replaced with methacrylate; and triallylcyanurate and triallyltrimellitate.

When the suspension polymerization is used as the process for producing toner particles, the dispersion stabilizer used may include inorganic dispersion stabilizers such as tricalcium phosphate, hydroxyapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, and starch. In the process for producing toner particles according to the present invention, the inorganic dispersion stabilizers are preferred in order to prevent toner particles from agglomerating in the step of removing organic volatile components. Any of the dispersion stabilizers may preferably be used in an amount of from 0.2 to 10.0 parts by weight based on 100 parts by weight of the polymerizable monomer.

The water or the aqueous medium may be used in an amount of from 300 to 3,000 parts by weight based on 100 parts by weight of the polymerizable monomer.

As the dispersion stabilizers, those commercially available may be used as they are. In order to obtain a dispersion stabilizer having a fine and uniform particle size, however, the inorganic dispersion stabilizer may be formed in the water or aqueous medium under high-speed agitation. For example, in the case of tricalcium phosphate or hydroxyapatite, an aqueous sodium phosphate solution and an aqueous calcium chloride solution may be mixed under high-speed agitation, whereby a dispersion stabilizer preferable for the suspension polymerization can be obtained. In order to make these dispersion stabilizers fine-particle, 0.001 to 0.1 part by weight of a surface-active agent may be used in combination. The surface-active agent may include commercially available nonionic, anionic or cationic surface-active agents. For example, it may include sodium dodecylsulfate, sodium tetradecylsulfate, sodium pentadecylsulfate, sodium octylsulfate, sodium oleate, sodium laurate, potassium stearate and calcium oleate.

An external additive may be added to the toner particles. It may preferably have a particle diameter not larger than 1/10 of a weight average particle diameter of the toner particles, in view of its durability when added externally to the toner particles. The particle diameter of this external additive refers to a number-average particle diameter obtained by observing the toner particles on an electron microscope. As the external additive, those as shown below may be used, for example.

Metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium carbonate; fatty acid metal salts such as zinc stearate and calcium stearate; carbon black; and silica. Any of these external additives may be used in an amount of from 0.01 to 10 parts by weight, and preferably from 0.05 to 5 parts by weight, based on 100 parts by weight of the toner particles. Any of these external additives may be used alone or in combination in plurality. External additives having been subjected to hydrophobic treatment with a silane coupling agent and/or a silicone oil are more preferred.

The particle size distribution of toners can be measured by various methods. In the present invention, it may preferably be measured with a COULTER COUNTER measuring instrument.

COULTER COUNTER MULTISIZER MODEL I, MODEL II or MODEL IIe (manufactured by Coulter Electronics, Inc.) is used as a measuring instrument. An interface (manufactured by Nikkaki k.k.) that outputs number-average distribution and volume-average distribution and a commonly available personal computer are connected. As an electrolytic solution, an aqueous 1% NaCl solution is prepared using super-high grade or first-grade sodium chloride.

Measurement is carried out by adding as a dispersant from 0.1 to 5 ml of a surface active agent (preferably an alkylbenzene sulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The particle size distribution of particles of from 2 $\mu$m to 40 $\mu$m in diameter is measured based on the number, by means of the above COULTER COUNTER MULTISIZER MODEL II and using an aperture of 100 $\mu$m as its aperture. Then, various values are determined.

Coefficient of variation in the above number average distribution is calculated from the following expression.

Coefficient of variation (%)=(S/D1)×100 wherein S represents standard deviation in the number distribution of tone toner particles, and D1 represents number-average particle diameter ($\mu$m) of the toner particles.

Other evaluation methods are detailed below.

Measurement of Particle Size Distribution of Release Agent in Liquid:

In evaluating the state of dispersion of the release agent used in the present invention, a laser diffraction/scattering particle size distribution measuring instrument LA-720 (manufactured by Horiba Seisakusho K.K.) is used to measure volume-average particle diameter in the following way to make evaluation.

First, to prepare a dispersion medium (liquid) used in measurement, using a batch type cell, the polymerizable monomer and a stirrer (magnetic stirrer) are put into it to the extent they fill the cell by 70 to 90% of the cell volume.

Figure 8:
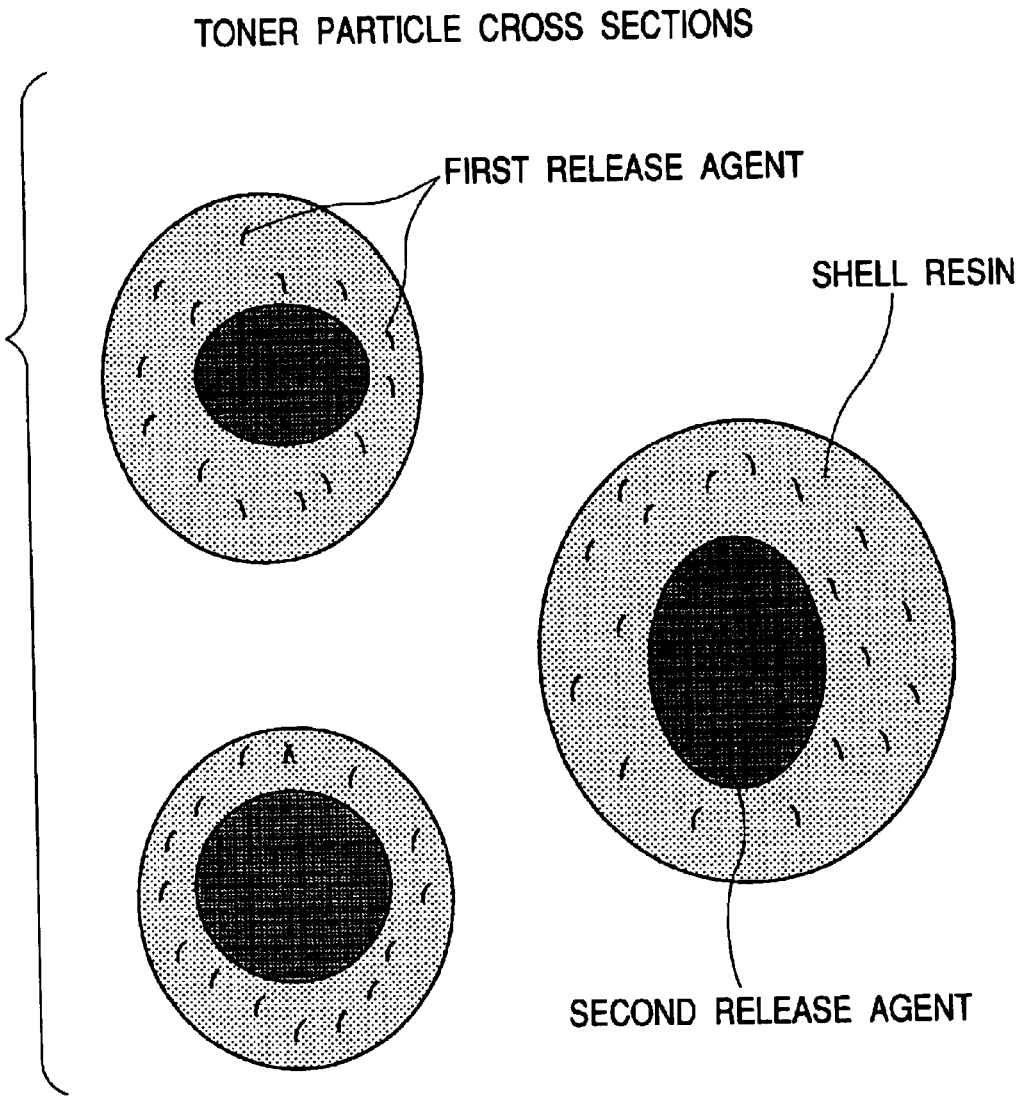
FIG. 8 is a sectional view of toner particles produced by the present invention in which preferred dispersion of a release agent has been achieved.

Meanwhile, the release agent is added to the polymerizable monomer in a stated proportion, followed by irradiation with ultrasonic waves for 3 minutes to prepare a sample to be measured. The sample thus prepared is so introduced into the dispersion medium that the release agent is in a concentration of from 70 to 95%, where its volume-average particle diameter is measured. As long as the measured volume-average particle diameter of the release agent is smaller than 1 $\mu$m, the release agent shows a good dispersibility in toner particles as shown in FIG. 8. If it is 1 to 4 $\mu$m, the release agent may unstably be dispersed in toner particles. If it is larger than 4 $\mu$m, the release agent may no longer be present in toner particles.

Observation of Dispersion State of Release Agent in Toner Particles:

As a method of evaluating the state of dispersion of the release agent in the toner particles in the present invention, a method is used in which cross sections of the toner particles are observed. As a specific method, toner particles are well dispersed in a cold curing epoxy resin, followed by curing in an environment of a temperature of 40° C. for 2 days. The cured product obtained is dyed with triruthenium tetraoxide optionally in combination with triosmium tetraoxide, and thereafter samples are cut out in slices by means of a microtome having a diamond cutter to observe the cross-sectional forms of toner particles using a transmission electron microscope (TEM). In the present invention, it is preferable to use the triruthenium tetraoxide dyeing method in order to form a contrast between the materials by utilizing some difference in crystallinity between the low-softening material used and the resin constituting the shell.

Evaluation of Dispersion of Colorant, Method 1:

The state of dispersion of the colorant in the fluid dispersion (fluid mixture) is measured by measuring glossiness (gloss) of the fluid dispersion. The glossiness of the fluid dispersion is measured on art paper having uniformly been coated with the fluid dispersion, followed by sufficient drying. As long as the colorant is well dispersed, smoothness and gloss are given to the coating surface, resulting in a high glossiness. If on the other hand the colorant is poorly dispersed, the coating surface stands uneven to look dull, bringing about a low glossiness. The glossiness (gloss) is measured with a glossmeter VG-10, manufactured by Nippon Denshoku K.K. In the measurement, the glossmeter is set at 6 V by a constant-voltage unit, and then light projection angle and light reception angle are set to 60° each. Using a zero-point adjustment and standard plate, three sheets of white paper are superposed on a sample stand after the setting of a standard, and the coated sample is placed thereon to measure the glossiness, where numerical values indicated on a display unit are read in units of %.

As evaluation criteria, the value of glossiness which is 40% or more shows that the colorant has good dispersibility; that which is 35% or more to less than 40% shows that images are somewhat problematic but the colorant has dispersibility of no problem in practical use; and that which is less than 35% shows that the colorant has poor dispersibility.

Evaluation of Dispersion of Colorant, Method 2:

As another method for the evaluation of the state of dispersion of the colorant in the fluid dispersion (fluid mixture), a laser diffraction/scattering particle size distribution measuring instrument LA-720 (manufactured by Horiba Seisakusho K.K.) is used to directly measure the volume-average particle diameter of the colorant in the fluid dispersion to make evaluation. As a method for the measurement, the fluid dispersion and a stirrer (magnetic stirrer) are put into a batch type cell to the extent they fill the cell by 70 to 90% of the cell volume to make measurement.

EXAMPLES

The present invention is described below in greater detain by giving Examples.

Example 1

The apparatus shown in FIGS. 5 and 6 (diameter of the first treatment ring 10: 100 mm) was used as the fine-dispersion machine in the dispersion step 61 shown in FIG. 1, and the step of dispersing a colorant was carried out.

First, 60 parts by weight of a styrene monomer, 8 parts by weight of a magenta colorant (C.I. Pigment Red 122) and 1 part by weight of a negative charge control agent (a salicylic-acid aluminum compound E-88, available from Orient Chemical Industries, Ltd.) were put into a container made ready for use, followed by pre-dispersion by means of THREEONE-MOTOR to prepare a first fluid mixture (first polymerizable-monomer fluid mixture).

Next, the first treatment ring 10 shown in FIGS. 5 and 6 was rotated at a number of revolutions set to 8,000 rpm. Compressed air of 600 kPa was introduced through the air feed port 44 to regulate the surface pressure between the first treatment ring 10 and the second treatment ring 20.

Thereafter, the first fluid mixture was introduced into the fine-dispersion machine from the container through the feed port 22 by means of the feed mechanism P (tube pump) at a flow rate of 200 g/min (12 kg/hr). Here, the electric power of the rotary derive unit 5 was measured to find that it was 1.5 kW. The fluid mixture introduced underwent the strong shear produced between the first treatment surface 1 and the second treatment surface 2. Thereafter, it was thrown out to the internal space 30, and then discharged out of the machine through the discharge port 32 as a second fluid mixture A. The second fluid mixture A (second polymerizable-monomer fluid mixture A) discharged, in which the colorant stood finely dispersed, was evaluated by the dispersion evaluation method 1 and the dispersion evaluation method 2 to find that the value of glossiness was 40% and the volume-average particle diameter was 0.1 $\mu$m. This second fluid mixture was prepared instantaneously within few seconds. To prepare this second fluid mixture, a power of 0.13 kWh/kg was necessary per unit weight.

Example 2

A second fluid mixture (second polymerizable-monomer fluid mixture) in which the colorant stood finely dispersed was obtained in the same manner as in Example 1 except that the number of revolutions of the first treatment ring 10 was set to 10,000 rpm and compressed air of 700 kPa was introduced through the air feed port 44. Here, the electric power of the rotary derive unit 5 was measured to find that it was 2.5 kW. The value of glossiness and volume-average particle diameter of the second polymerizable-monomer fluid mixture obtained were measured to find that they were 48% and 0.07 $\mu$m, respectively. This second fluid mixture was prepared instantaneously within few seconds. To prepare this second fluid mixture, a power of 0.21 kWh/kg was necessary per unit weight.

Comparative Example 1

A first fluid mixture (first polymerizable-monomer fluid mixture) was prepared in the same manner as in Example 1. Then, 2 kg of the first polymerizable-monomer fluid mixture obtained was subjected to dispersion by means of an attritor (manufactured by Mitsui Mining and Smelting Co., Ltd.) using media (zirconia beads) of 2 mm in diameter. Here, the electric power required was measured to find that it was 0.4 kW. The fluid mixture was sampled at constant time intervals. As the result, it took 3 hours for its glossiness and volume-average particle diameter to reach 40% and 0.1 $\mu$m, respectively, thus it took a longer time to carry out dispersion than that in Example 1 or 2. To prepare this fluid mixture, a power of 0.60 kWh/kg was necessary per unit weight.

Example 3

The apparatus shown in FIGS. 5 and 6 (diameter of the first treatment ring 10: 100 mm) was used as the fine-dispersion machine in the dispersion step 61*a* shown in FIG. 2, and the step of dispersing a release agent was carried out.

First, 30 parts by weight of a styrene monomer, 3.5 parts by weight of a release agent (low-molecular-weight polyethylene wax PW850, available from Toyo Petroleum Co.; melting point: 105° C.) were put into a container made ready for use, followed by pre-dispersion by means of THREEONE-MOTOR to prepare a first fluid mixture (first polymerizable-monomer fluid mixture).

Next, the first treatment ring 10 shown in FIGS. 5 and 6 was rotated at a number of revolutions set to 8,000 rpm. Compressed air of 600 kPa was introduced through the air feed port 44 to regulate the surface pressure between the first treatment ring 10 and the second treatment ring 20. Thereafter, the first fluid mixture was introduced into the fine-dispersion machine from the container through the feed port 22 by means of the feed mechanism P (tube pump) at a flow rate of 400 g/min (24 kg/hr). The fluid mixture introduced underwent the strong shear produced between the first treatment surface 1 and the second treatment surface 2. Thereafter, it was thrown out to the internal space 30, and then discharged out of the machine through the discharge port 32 as a second fluid mixture B. The second fluid mixture B (second polymerizable-monomer fluid mixture B) discharged was evaluated by the dispersion evaluation methods to find that the release agent stood dispersed having a volume-average particle diameter of 0.8 $\mu$m.

Next, into a container for the granulation step 63 shown in FIG. 2, 400 parts by weight of ion-exchanged water and 5 parts by weight of $Na_3PO_4$ were introduced. The mixture formed was heated to 60° C., and then agitated by means of CLEARMIX 0.8S (manufactured by M. Technique K.K.; peripheral speed: 22 m/s) installed. Then, an aqueous $CaCl_2$ solution prepared by dissolving 3 parts by weight of $CaCl_2$ in 20 parts by weight of ion-exchanged water was added thereto to obtain an aqueous dispersion medium containing $Ca_3(PO_4)_2$.

Meanwhile, the second polymerizable-monomer fluid mixture A obtained in Example 1, in which the colorant stood finely dispersed, and the second polymerizable-monomer fluid mixture B obtained in this Example, in which the release agent stood finely dispersed, were introduced into a container of the dissolution step 62 shown in FIG. 2. Then, additives shown below were added.

| | (by weight) |
|---|---|
| n-Butyl acrylate | 17 parts |
| Polar resin, terephthalic acid-propylene oxide modified bisphenol A (acid value: 10 mg · KOH/g; peak molecular weight: 7,500) | 5 parts |
| Divinylbenzene (purity: 55%) | 0.2 part |
| Second release agent, behenyl behenate (melting point: 72° C.) | 10 parts |

The above materials were heated to 60° C. with agitation in the container of the dissolution step 62 to dissolve or disperse the materials uniformly in the polymerizable monomer. In the resultant mixture, 3 parts by weight of a 2,2'-azobis(2,4-dimethylvaleronitrile) was dissolved as a polymerization initiator to prepare a polymerizable monomer composition.

Into the aqueous dispersion medium held in the container of the granulation step 63, the polymerizable monomer composition held in the container of the dissolution step 62 was introduced, followed by agitation at a temperature of at 60° C. and in an $N_2$ atmosphere for 15 minutes by means of an agitator (CLEARMIX granulator, manufactured by M. Technique K.K.) in the container of the granulation step 63 (tip peripheral speed of blade: 22 m/s) to carry out granulation to form particles of the polymerizable monomer composition in the aqueous dispersion medium. Thereafter, the agitator in the container of the granulation step 63 was stopped, and the contents in the container for granulation were introduced into a container of the polymerization step 64, having FULL-ZONE agitating blades (manufactured by Shinko Pantekku K.K.). In the container of the polymerization step 64, the polymerizable monomer was allowed to react for 5 hours at a temperature of 60° C. in an atmosphere of $N_2$ while the contents were agitated by means of the agitating blades (agitation maximum peripheral speed: 3 m/s). Thereafter, the temperature was raised to 80° C. to allow the polymerizable monomer to react for further 5 hours to obtain toner particles.

On the toner particles thus obtained, the state of dispersion of the release agent was confirmed by the method described previously. As the result, the release agent was seen to stand well dispersed therein as shown in FIG. 8.

Example 4

A second polymerizable-monomer fluid mixture in which a release agent stood dispersed was obtained in the same manner as in Example 3 except that Fischer-Tropsch wax (FT100, available from Nippon Seiro K.K.; melting point: 87° C.) synthesized from hydrogen and carbon monoxide was used as an additional release agent. The state of its dispersion was evaluated by the release agent dispersion evaluation method to find that the release agent stood finely dispersed having a volume-average particle diameter of 0.40 μm. The subsequent procedure of Example 3 was repeated to obtain toner particles. In the toner particles obtained, a high-melting first release agent and a low-melting second release agent were seen to be in the state that the low-melting second release agent formed cores and the high-melting first release agent was finely well dispersed in the shell resin as shown in FIG. 8.

Example 5

A second polymerizable-monomer fluid mixture was obtained in the same manner as in Example 4 except that the number of revolutions of the first treatment ring 10 was set to 10,000 rpm and compressed air of 700 kPa was introduced through the air feed port 44. The state of dispersion in the second polymerizable-monomer fluid mixture obtained was evaluated to find that the release agent stood finely dispersed having a volume-average particle diameter of 0.2 μm. Subsequently, the procedure of Example 3 was repeated to obtain toner particles, and the state of dispersion of the release agent was confirmed. As the result, the release agent was seen to stand well dispersed as shown in FIG. 8.

Comparative Example 2

A first polymerizable-monomer fluid mixture containing a release agent was prepared in the same manner as in Example 3. Then, 2 kg of the first polymerizable-monomer fluid mixture obtained was subjected to dispersion for 1 hour at a number of revolutions of 24,000 rpm by means of an agitator (ULTRA-TURRAX Model T25, manufactured by IKA K.K.; rotor diameter: 18 mm). The state of dispersion in the second polymerizable-monomer fluid mixture obtained was evaluated to find that the release agent was in a volume-average particle diameter of 35 μm. Subsequently, the procedure of Example 3 was repeated to obtain toner particles, and the state of dispersion of the release agent was confirmed. As the result, the first release agent as shown in FIG. 8 was not seen. It was considered that the release agent was dispersed so insufficiently that it was not incorporated into the toner particles.

Example 6

The granulating machine according to the present invention was used in the granulation step 63 shown in FIG. 3.

Using the dispersion step 61 and dissolution step 62 shown in FIG. 3, a polymerizable monomer composition was prepared in the same manner as in Example 3. Meanwhile, in the aqueous dispersion medium preparation step 66, 400 parts by weight of ion-exchanged water and 5 parts by weight of $Na_3PO_4$ were introduced. The mixture formed was heated to 60° C., and then agitated by means of dissolver blades (manufactured by M. Technique K.K.; peripheral speed: 15 m/s) installed. Then, an aqueous $CaCl_2$ solution prepared by dissolving 3 parts by weight of $CaCl_2$ in 20 parts by weight of ion-exchanged water was added thereto to obtain an aqueous dispersion medium containing $Ca_3(PO_4)_2$.

Next, in the apparatus shown in FIGS. 5 and 6, used as the granulating machine, the first treatment ring 10 was rotated at a number of revolutions set to 6,000 rpm. Compressed air of 100 kPa was introduced through the air feed port 44 to regulate the surface pressure between the first treatment ring 10 and the second treatment ring 20. Thereafter, the polymerizable monomer composition and the aqueous dispersion medium were introduced in a stated proportion into the granulating machine from the container through the feed port 22 by means of the feed mechanism P (tube pump). These were introduced at a flow rate of 400 g/min (24 kg/hr) for the polymerizable monomer composition and the aqueous dispersion medium in total. The granulation fluid introduced underwent the strong shear produced between the first treatment surface 1 and the second treatment surface 2. Thereafter, it was thrown out to the internal space 30, and then discharged out of the machine through the discharge port 32 as a slurry. The slurry discharged was, while being temperature-controlled at 60° C., introduced into a container for the polymerization step 64, having FULL-ZONE agitating blades (manufactured by Shinko Pantekku K.K.). In the container for the polymerization step 64, the polymerizable monomer was allowed to react for 5 hours at a temperature of 60° C. in an atmosphere of $N_2$ while the contents were agitated by means of the agitating blades (agitation maximum peripheral speed: 3 m/s). Thereafter, the temperature was raised to 80° C. to allow the polymerizable monomer to react for further 5 hours to obtain toner particles.

The particle size distribution of the toner particles obtained was measured with the COULTER COUNTER described previously, to find that the toner particles had a volume-average particle diameter of 6.8 μm and a coefficient of number variation of 21%, having a sharp particle size distribution.

Example 7

The granulating machine according to the present invention was used in the granulation step 63 shown in FIG. 4.

Using the dispersion step 61 and dissolution step 62 shown in FIG. 4, a polymerizable monomer composition was prepared in the same manner as in Example 3. Meanwhile, in the pre-dispersion step 67, 400 parts by weight of ion-exchanged water and 5 parts by weight of $Na_3PO_4$ were introduced. The mixture formed was heated to 60° C., and then agitated by means of an agitator (dissolver blades manufactured by M. Technique K.K.; peripheral speed: 15 m/s) installed. Then, an aqueous $CaCl_2$ solution prepared by dissolving 3 parts by weight of $CaCl_2$ in 20 parts by weight of ion-exchanged water was added thereto to obtain an aqueous dispersion medium containing $Ca_3(PO_4)_2$. Thereafter, the above polymerizable monomer composition was introduced to the pre-granulation step 67, where the granulation was carried out for 30 minutes. During the granulation, temperature was conditioned at 60° C.

Next, in the apparatus shown in FIGS. 5 and 6, used as the granulating machine, the first treatment ring 10 was rotated at a number of revolutions set to 6,000 rpm. Compressed air of 100 kPa was introduced through the air feed port 44 to regulate the surface pressure between the first treatment ring 10 and the second treatment ring 20. Thereafter, the pre-granulated fluid obtained was introduced into the granulating machine from the container through the feed port 22 by means of the feed mechanism P (tube pump) at a flow rate of 400 g/min (24 kg/hr). The granulation fluid introduced underwent the strong shear produced between the first treatment surface 1 and the second treatment surface 2. Thereafter, it was thrown out to the internal space 30, then discharged out of the machine through the discharge port 32 as a slurry and thereafter returned again to the pre-granulation step 67. The slurry having thus circulated between the pre-granulation step 67 and the granulation step 63 was, while being temperature-controlled at 60° C., circulatively treated for 15 minutes until the desired fine particles were formed. Thereafter, this slurry was introduced into a container for the polymerization step 64, having FULL-ZONE agitating blades (manufactured by Shinko Pantekku K.K.). In the container for the polymerization step 64, the polymerizable monomer was allowed to react for 5 hours at a temperature of 60° C. in an atmosphere of $N_2$ while the contents were agitated by means of the agitating blades 5 (agitation maximum peripheral speed: 3 m/s). Thereafter, the temperature was raised to 80° C. to allow the polymerizable monomer to react for further 5 hours to obtain toner particles.

The particle size distribution of the toner particles obtain was measured with the COULTER COUNTER described previously, to find that the toner particles had a volume-average particle diameter of 6.7 μm and a coefficient of number variation of 20%, having a sharp particle size distribution.

Comparative Example 3

Toner particles were obtained in the same manner as in Example 6 except that the granulating machine used in the granulation step 63 was changed for EBARA MIXER, its peripheral speed being set at 32 m/s, and the polymerizable monomer composition and the aqueous dispersion medium were introduced at a flow rate of 300 g/min (18 kg/hr) in total.

The particle size distribution of the toner particles obtain was measured with the COULTER COUNTER described previously, to find that the toner particles had a volume-average particle diameter of 9.7 μm and a coefficient of number variation of 36%, having a broad particle size distribution.

Conditions and evaluation results in the above Examples and Comparative Examples are shown together in Table 1.

TABLE 1

| | Apparatus | Condition 1 | Condition 2 | Evaluation 1 | Evaluation 2 | Evaluation 3 |
|---|---|---|---|---|---|---|
| Example 1: | CLEAR SS5 | Magenta pigment | No. of rev.: 8,000 rpm | Particle diameter: 0.1 μm | Glossiness: 40% | Power: 0.13 kWh/kg |
| Example 2: | CLEAR SS5 | Magenta pigment | No. of rev.: 10,000 rpm | Particle diameter: 0.07 μm | Glossiness: 48% | Power: 0.21 kWh/kg |
| Comparative Example 1: | Media mill | Magenta pigment | — | Particle diameter: 0.1 μm | Glossiness: 40% | Power: 0.6 kWh/kg |
| Example 3: | CLEAR SS5 | Release agent: PW850 | No. of rev.: 8,000 rpm | Particle diameter: 0.8 μm | State of dispersion: good | — |
| Example 4: | CLEAR SS5 | Release agent: FT100 | No. of rev.: 8,000 rpm | Particle diameter: 0.4 μm | State of dispersion: good | — |
| Example 5: | CLEAR SS5 | Release agent: FT100 | No. of rev.: 10,000 rpm | Particle diameter: 0.2 μm | State of dispersion: good | — |
| Comparative Example 2: | Colloid mill | Release agent: FT100 | No. of rev.: 10,000 rpm | Particle diameter: 35 μm | State of dispersion: poor | — |
| Example 6: | CLEAR SS5 | System: FIG. 3 | No. of rev.: 6,000 rpm; Peripheral speed: 32 m/s | Particle diameter: 6.8 μm | Coefficient of variation: 21% | — |
| Example 7: | CLEAR SS5 | System: FIG. 4 | No. of rev.: 6,000 rpm; Peripheral speed: 32 m/s | Particle diameter: 6.7 μm | Coefficient of variation: 20% | — |
| Comparative Example 3: | Colloid mill | System: FIG. 3 | Peripheral speed: 32 m/s | Particle diameter: 9.7 μm | Coefficient of variation: 36% | — |

What is claimed is:

1. A process for producing toner particles, which comprises:

pre-dispersing at least a colorant or a release agent or a mixture of these in a first dispersion medium to prepare a first fluid mixture;

preparing a second fluid mixture through a dispersion step of dispersing the colorant or the release agent or the mixture of these contained in the first fluid mixture by means of a fine-dispersion machine to obtain fine particles of the colorant, fine particles of the release agent or fine particles of the mixture of these; and adding a second dispersion medium to the second fluid mixture to form toner particles from the second fluid mixture;

wherein;

(i) said fine-dispersion machine has:

at least a first treatment ring and a second treatment ring which is approachable to and separable from the first treatment ring; and a rotary drive mechanism which makes the first treatment ring rotate relatively to the second treatment ring;

said second treatment ring being pressed against the first treatment ring when the first treatment ring stands stationary; and (ii) said first fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second fluid mixture.

2. The process according to claim 1, wherein said first dispersion medium comprises a polymerizable monomer, and said second fluid mixture comprises a polymerizable monomer.

3. The process according to claim 2, wherein said second fluid mixture is dispersed in an aqueous dispersion medium, and particles of said second fluid mixture are formed in the aqueous dispersion medium, where the polymerizable monomer of said second fluid mixture is polymerized to produce a polymer or a copolymer to obtain the toner particles.

4. The process according to claim 3, wherein said toner particles are produced by suspension polymerization.

5. The process according to claim 1, wherein said first dispersion medium comprises a polymerizable monomer, and said second dispersion medium comprises a polymerizable monomer.

6. The process according to claim 1, wherein said first dispersion medium comprises an aqueous medium, the colorant is finely dispersed in the aqueous medium by means of said fine-dispersion machine to prepare the second fluid mixture, and a fine resin particle dispersion is added to the second fluid mixture as the second dispersion medium to make the colorant and fine resin particles agglomerate to obtain the toner particles.

7. The process according to claim 6, wherein said first dispersion medium comprises water and a surface-active agent.

8. The process according to claim 6, wherein said first dispersion medium comprises water and a surface-active agent, and said fine resin particle dispersion comprises a fine resin particle dispersion prepared by emulsion polymerization.

9. A process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture by means of a fine-dispersion machine to obtain fine particles of the colorant, fine particles of the release agent or fine particles of the mixture of these;

dispersing the resultant second polymerizable-monomer fluid mixture in an aqueous dispersion medium containing a dispersion stabilizer, to carry out granulation to obtain particles of the polymerizable-monomer fluid mixture; and polymerizing the polymerizable monomer present in the particles of the polymerizable-monomer fluid mixture to obtain toner particles;

wherein;

(i) said fine-dispersion machine has:

at least a first treatment ring and a second treatment ring which is approachable to and separable from the first treatment ring; and a rotary drive mechanism which makes the first treatment ring rotate relatively to the second treatment ring;

said second treatment ring being pressed against the first treatment ring when the first treatment ring stands stationary; and (ii) said first polymerizable-monomer fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second polymerizable-monomer fluid mixture.

10. A process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture by means of a fine-dispersion machine to obtain fine particles of the colorant, fine particles of the release agent or fine particles of the mixture of these;

adding an additive to the resultant second polymerizable-monomer fluid mixture to obtain a third polymerizable-monomer fluid mixture;

dispersing the resultant third polymerizable-monomer fluid mixture in an aqueous dispersion medium containing a dispersion stabilizer, to carry out granulation to obtain particles of the polymerizable-monomer fluid mixture; and polymerizing the polymerizable monomer present in the particles of the polymerizable-monomer fluid mixture to obtain toner particles;

wherein;

(i) said fine-dispersion machine has:

at least a first treatment ring and a second treatment ring which is approachable to and separable from the first treatment ring; and a rotary drive mechanism which makes the first treatment ring rotate relatively to the second treatment ring;

said second treatment ring being pressed against the first treatment ring when the first treatment ring stands stationary; and (ii) said first polymerizable-monomer fluid mixture is introduced to the part between the first treatment ring and the second treatment ring to make the second treatment ring separate from the first treatment ring, and the colorant or the release agent or the mixture of these are dispersed in the form of fine particles by the aid of the rotation of the first treatment ring to obtain the second polymerizable-monomer fluid mixture.

11. A process for producing toner particles, which comprises:

pre-dispersing at least a colorant or a release agent or a mixture of these in a polymerizable monomer to prepare a first polymerizable-monomer fluid mixture;

preparing a second polymerizable-monomer fluid mixture through a dispersion step of dispersing the colorant or the release agent or the mixture of these contained in the first polymerizable-monomer fluid mixture by means of a fine-dispersion machine to obtain fine particles of the colorant, fine particles of the release agent or fine particles of the mixture of these;

adding an additive to the resultant second polymerizable-monomer fluid mixture to obtain a third polymerizable-monomer fluid mixture;

dispersing the resultant third polymerizable-monomer fluid mixture in an aqueous dispersion medium containing a dispersion stabilizer, to carry out granulation by means of a granulating machine to obtain particles of the third polymerizable-monomer fluid mixture; and polymerizing the polymerizable monomer present in the particles of the polymerizable-monomer fluid mixture to obtain toner particles;

wherein;

(i) said granulating machine has:

at least a first treatment ring and a second treatment ring which is approachable to and separable from the first treatment ring; and a rotary drive mechanism which makes the first treatment ring rotate relatively to the second treatment ring;

said second treatment ring being pressed against the first treatment ring when the first treatment ring stands stationary; and (ii) said third polymerizable-monomer fluid mixture and said aqueous dispersion medium are introduced to the part between the first treatment ring and the second treatment ring to make the second treatment ring separate from the first treatment ring, and the third polymerizable-monomer fluid mixture is dispersed in said aqueous dispersion medium by the aid of the rotation of the first treatment ring to carry out granulation to obtain particles of the third polymerizable-monomer fluid mixture.

* * * * *